US008246241B2

(12) United States Patent
Ashmead et al.

(10) Patent No.: US 8,246,241 B2
(45) Date of Patent: Aug. 21, 2012

(54) MIXING DEVICE HAVING A CORRUGATED CONVEYING PLATE

(75) Inventors: James William Ashmead, Middletown, DE (US); William Gerald Dimaio, Jr., Boothwyn, PA (US)

(73) Assignee: Actamax Surgical Materials, LLC, Berkeley, CA (US)

( * ) Notice: Subject to any disclaimer, the term of this patent is extended or adjusted under 35 U.S.C. 154(b) by 610 days.

(21) Appl. No.: 12/485,317

(22) Filed: Jun. 16, 2009

(65) Prior Publication Data

US 2009/0316517 A1 Dec. 24, 2009

Related U.S. Application Data

(60) Provisional application No. 61/073,559, filed on Jun. 18, 2008, provisional application No. 61/073,563, filed on Jun. 18, 2008, provisional application No. 61/073,565, filed on Jun. 18, 2008, provisional application No. 61/073,570, filed on Jun. 18, 2008, provisional application No. 61/073,551, filed on Jun. 18, 2008, provisional application No. 61/073,546, filed on Jun. 18, 2008, provisional application No. 61/073,539, filed on Jun. 18, 2008, provisional application No. 61/073,557, filed on Jun. 18, 2008.

(51) Int. Cl.
*B01F 5/06* (2006.01)

(52) U.S. Cl. ..... 366/181.5; 366/341; 366/DIG. 1; 222/145.5

(58) Field of Classification Search ..... 366/181.5, 366/336–341, DIG. 1–DIG. 4; 222/145.5–145.6; 48/189.4, 189.6
See application file for complete search history.

(56) References Cited

U.S. PATENT DOCUMENTS

| | | | | |
|---|---|---|---|---|
| 5,803,600 | A * | 9/1998 | Schubert et al. | 366/144 |
| 6,082,891 | A * | 7/2000 | Schubert et al. | 366/338 |
| 6,132,079 | A | 10/2000 | King | |
| 6,305,834 | B1 * | 10/2001 | Schubert et al. | 366/144 |
| 6,321,998 | B1 | 11/2001 | Schubert et al. | |
| 6,863,867 | B2 * | 3/2005 | Vanden Bussche et al. | 422/129 |
| 7,192,562 | B1 | 3/2007 | Towler et al. | |
| 2001/0048637 | A1 * | 12/2001 | Weigl et al. | 366/341 |
| 2003/0039169 | A1 | 2/2003 | Ehrfeld et al. | |
| 2005/0068845 | A1 * | 3/2005 | Oohashi et al. | 366/177.1 |
| 2009/0314416 | A1 * | 12/2009 | Ashmead et al. | 156/153 |
| 2009/0316516 | A1 * | 12/2009 | Ashmead et al. | 366/134 |

(Continued)

FOREIGN PATENT DOCUMENTS

DE 19541265 5/1997

(Continued)

OTHER PUBLICATIONS

International Search Report, PCT/US2009/047482, dated Oct. 10, 2009.

*Primary Examiner* — Charles E Cooley
(74) *Attorney, Agent, or Firm* — McCarter & English

(57) ABSTRACT

A mixing device for mixing adhesives containing at least two components comprises a conveying plate having first and second grooved surfaces each overlaid by a respective cover plate. The conveying plate and the opposed cover plates cooperate to define a plurality of separated channels extending through the mixing device. The discharge ends of the channels are interdigitated. First and a second distribution manifolds are defined within the mixing device. A supply port adapted to receive one adhesive component extends through a respective cover plate into fluid communication with one of the distribution manifolds.

21 Claims, 20 Drawing Sheets

U.S. PATENT DOCUMENTS

2009/0316517 A1* 12/2009 Ashmead et al. ..... 366/134

FOREIGN PATENT DOCUMENTS

| | | |
|---|---|---|
| EP | 0669100 | 11/1998 |
| EP | 1623760 | 2/2006 |
| EP | 1908514 | 4/2008 |
| GB | 1333531 | 10/1973 |
| WO | WO 0143857 | 6/2001 |
| WO | WO02/055138 | 7/2002 |

* cited by examiner

MIXING DEVICE HAVING A CORRUGATED CONVEYING PLATE

CLAIM OF PRIORITY

This application claims priority from each of the following U.S. Provisional Applications, hereby incorporated by reference:

(1) Mixing Device Having Opposed Supply Ports and A Corrugated Conveying Plate, Application Ser. No. 61/073,559, filed 18 Jun. 2008 (CL-4042);

(2) Adhesive Dispenser Apparatus Having Opposed Supply Ports, Application Ser. No. 61/073,563, filed 18 Jun. 2008 (CL-4293);

(3) Mixing Device Having Rearwardly Positioned Supply Ports And A Corrugated Conveying Plate, Application Ser. No. 61/073,565, filed 18 Jun. 2008 (CL-4294);

(4) Adhesive Dispenser Apparatus Having Rearwardly Positioned Supply Ports, Application Ser. No. 61/073,570, filed 18 Jun. 2008 (CL-4295);

(5) Mixing Device Having Laterally Adjacent Supply Ports And A Corrugated Conveying Plate, Application Ser. No. 61/073,551, filed 18 Jun. 2008 (CL-4296);

(6) Adhesive Dispenser Apparatus Having Laterally Adjacent Supply Ports, Application Ser. No. 61/073,546, filed 18 Jun. 2008 (CL-4297);

(7) Method For Fabricating A Mixing Device Having A Corrugated Conveying Plate, Application Ser. No. 61/073,539, filed 18 Jun. 2008 (CL-4298); and (8) Method For Fabricating A Dispenser Apparatus Having A Mixing Device With A Corrugated Conveying Plate, Application Ser. No. 61/073,557, filed 18 Jun. 2008 (CL-4318).

BACKGROUND OF THE INVENTION

1. Field of the Invention

This invention relates to apparatus used in the dispensing of fast-setting multi-component adhesives, particularly medical adhesives, and more specifically, to various embodiments of a mixing device for mixing a multi-part polymer tissue adhesive, to a method for fabricating the same, to a dispenser apparatus incorporating the mixing device and to a method for fabricating the dispenser apparatus.

2. Description of the Prior Art

A fast-setting two-component adhesive is an adhesive compound that cures within seconds of the components being mixed together. Such fast-setting two-component adhesives have many applications, including use as tissue adhesives for a number of potential medical applications. Such potential medical applications include closing topical wounds, adhering synthetic onlays or inlays to the cornea, delivering drugs, providing anti-adhesion barriers to prevent post-surgical adhesions, and supplementing or replacing sutures or staples in internal surgical procedures. To be suitable for medical applications such tissue adhesives must be fast-curing, have good mechanical strength, be able to bind to the underlying tissue and pose no risk of viral infection. It is particularly important for internal applications that such tissue adhesives not release toxic degradation products.

The components of such fast-setting two-component adhesives must be mixed at the site of application or immediately (i.e., typically within a few seconds) before application. Conventional static mixers have been employed to mix the two components together as the adhesive is applied to the tissue. These conventional static mixers typically employ a serpentine passage. The mixing action occurs within the serpentine passage before the adhesive exits the mixing passage. Representative of such conventional static mixer are those devices sold by Med Mix Systems AG, Rotkreuz, Switzerland and Mix Tek System LLC, New York, N.Y.

U.S. Pat. No. 5,595,712, assigned to the assignee of the present invention, also discloses a static mixing device employing a serpentine passage within a planar structure.

These prior art static mixers are believed disadvantageous for use in any medical application which requires intermittent application of adhesive. If flow of the adhesive through the mixer is interrupted, even momentarily, the mixed components rapidly increase in viscosity. This increase in viscosity, known as gelling, may occur so rapidly that the mixer passage becomes clogged, thus preventing the resumption of flow of the adhesive.

Besides the static mixers previously described, dynamic mixers such as powered impellers and magnetic stir bars have been used. However these devices are costly and cumbersome and not particularly amenable to medical use as they may damage the adhesive by over-mixing.

Accordingly, in view of the foregoing there is believed to be a need for a mixing device capable of adequately mixing fast-setting multi-component adhesives without experiencing the clogging problems of prior art devices and a dispenser apparatus employing the same.

SUMMARY OF THE INVENTION

In a first aspect the present invention is directed to a mixing device for mixing adhesives containing at least two components. The mixing device comprises a conveying plate having first and second surfaces thereon, with each surface being overlaid by a respective first and second cover plate. Each surface of the conveying plate has a plurality of grooves formed therein, with each groove on each surface being separated from an adjacent groove on that surface by an intermediate land. The overlaying cover plates are disposed in contact with the lands on the respective first and second surfaces of the conveying plate.

The cover plates and the respective surfaces of the conveying plate cooperate to define a plurality of separated channels extending through the mixing device. Each channel has a supply end and a discharge end. The channels are interdigitally arranged. That is, the discharge end of each channel formed from a groove on one surface of the conveying plate and its corresponding overlaying cover plate is next adjacent to the discharge end of at least one of the channels formed from a groove on the other surface of the conveying plate and its corresponding overlaying cover plate.

Each of the cover plates and a respective surface of the conveying plate cooperate to define a first and a second distribution manifold within the mixing device. Each distribution manifold respectively communicates with the supply end of the first and second sets of channels. A first and a second supply port, each adapted to receive one of the components of the adhesive, are disposed in fluid communication with a respective one of the first and second distribution manifolds.

In a first embodiment of the mixing device of the present invention each supply port extends through a respective one of the opposed cover plates into fluid communication with the distribution manifold defined between that cover plate and the conveying plate.

In a second embodiment of the mixing device rear edge surfaces on the cover plates and on the conveying plate cooperate to define a posterior surface of the mixing device. In this embodiment the supply ports extend through the posterior surface of the mixing device into fluid communication with the respective distribution manifolds. In particular, the supply ports are defined by registered openings in the rear edge surfaces of the cover plates and the conveying plate.

In a third embodiment of the mixing device isolated laterally adjacent supply ports open on the surface of one of the cover plates. The first supply port extends through the first cover plate into communication with the first distribution manifold. The second supply port extends through both the first cover plate and the conveying plate into fluid communication with the second distribution manifold defined between the second cover plate and the other surface of the conveying plate.

-o-0-o-

In another aspect the present invention is directed to an adhesive dispenser apparatus incorporating one of the embodiments of the mixing devices summarized above.

The dispenser apparatus includes a mixing device and a header connected to the first and second cover plates. The header has a first and second passage extending therethrough. The header is connected (i.e., physically abutted in a fluid-tight manner) against the mixing device so that the passages in the header are respectively disposed in fluid communication with the first and second supply ports in the mixing device.

In a first embodiment the dispenser utilizes the first embodiment of the mixing device. The header is formed from a first and a second header block conjoined together. Each header block is physically attached, as with an epoxy adhesive, to a major surface of one of the cover plates.

In a second embodiment the dispenser utilizes the second embodiment of the mixing device. The header in this embodiment of the invention is formed as a unitary block that is physically attached, as with an epoxy adhesive, to at least the rear edge surface of the conveying plate. Additionally or alternatively, the header may be physically attached to at least one of the cover plates, on either the rear edge surface of a cover plate and/or a major surface of a cover plate.

In a third embodiment the dispenser utilizes the third embodiment of the mixing device. In this embodiment of the invention the header is formed as a unitary block that is physically attached, as with an epoxy adhesive, to the cover plate on which the supply ports open.

-o-0-o-

In another aspect the present invention is directed to a method for fabricating a mixing device. The method comprises the steps of:

a) providing a grooved conveying plate;

b) bonding recessed first and a second cover plates to respective surfaces of the conveying plate, thereby to define first and second sets of separated interdigitated channels and first and second distribution manifolds; and c) forming respective supply ports through surface(s) of the cover plates. Each port is disposed in fluid communication with a respective distribution manifold.

Preferably, the conveying plate is silicon, and the cover plates are glass. The grooves on the conveying plate are formed by etching. The bonding step is performed by anodically bonding the glass cover plates to the silicon conveying plate.

-o-0-o-

Still another aspect the present invention is directed to a method for fabricating a dispenser apparatus for dispensing an adhesive containing at least two components. The method comprises the steps of:

a) fabricating a mixing device having a grooved conveying plate with bonded cover plates forming sets of separated interdigitated channels, distribution manifolds communicating with the channels, and supply ports disposed in fluid communication with the manifolds; and b) connecting a header having passages formed therein to the mixing device so that the header is physically abutted in a fluid-tight manner against the mixing device and the passages in the header are disposed in fluid communication with the supply ports in the mixing device.

BRIEF DESCRIPTION OF THE DRAWINGS

The invention will be more fully understood from the following detailed description taken in connection with the accompanying Figures, which form a part of this application and in which.

DETAILED DESCRIPTION OF THE INVENTION

Figure 1:
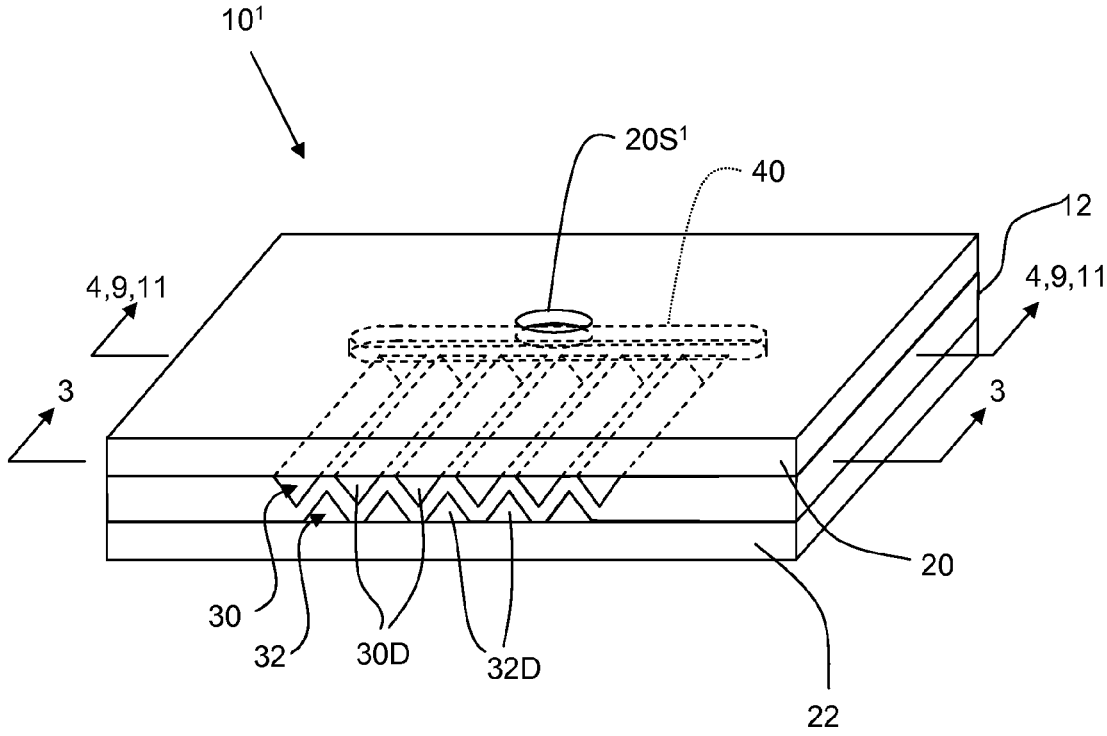
FIG. 1 is a perspective view of a mixing device having opposed supply ports in accordance with a first embodiment of the present invention.

Throughout the following detailed description similar reference numerals refer to similar elements in all figures of the drawings.

FIGS. 1 through 5 show a first embodiment of a mixing device generally indicated by reference character 101 in accordance with one aspect of the present invention. The mixing device 101 enables the intermittent application of a sufficiently mixed two-component adhesive to a desired region of tissue while eliminating the clogging associated with static mixers of the prior art.

Figure 5:
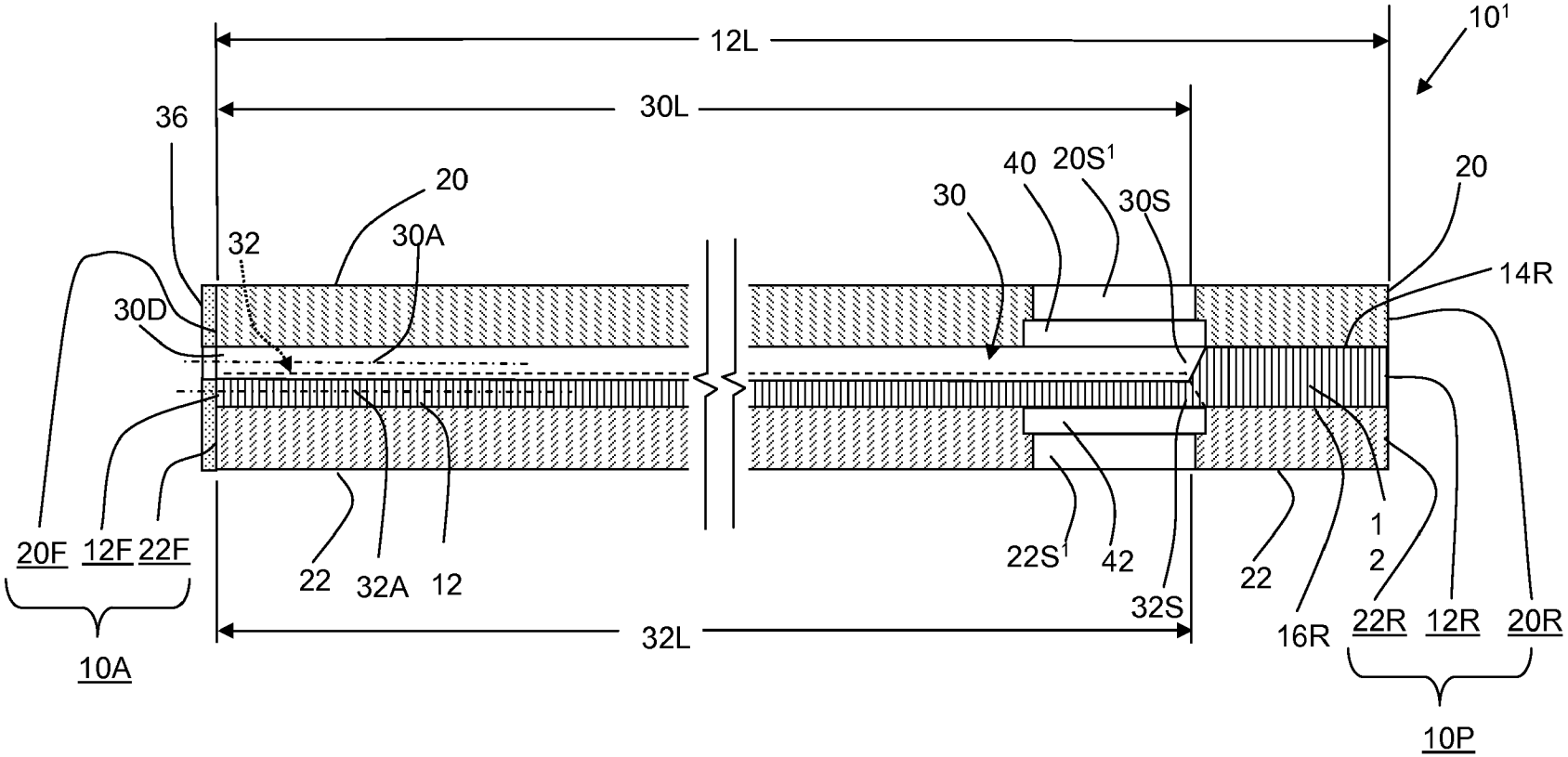
FIG. 5 is a section view taken along section lines 5-5 in FIG. 4.

The mixing device 101 comprises a central conveying plate 12 overlaid by a respective first and second cover plate 20, 22. Each cover plate 20, 22 has a respective front edge surface 20F, 22F (FIGS. 2, 5) and a respective rear edge surface 20R, 22R (FIG. 5). The cover plates are preferably formed from borosilicate glass. Alternatively, the cover plates may be formed from a polymeric material, a composite material, a crystalline material, and/or a metal. The cover plates are typically one millimeter (1.0 mm) thick.

The central conveying plate 12 has respective first and second major surfaces 14, 16 (FIG. 2) and respective minor front edge surface 12F (FIGS. 2, 5) and minor rear edge surface 12R (FIG. 5). The front edge surface 12F and the front edge surfaces 20F and 22F of the cover plates 20, 22 cooperate to form an anterior surface 10A of the mixing device $\mathbf{10}^1$ (FIG. 5). Similarly, the rear edge surface 12R and the rear edge surfaces 20R and 22R of the cover plates 20, 22 cooperate to form a posterior surface 10P of the mixing device 101.

The conveying plate 12 is preferably formed from <100> crystalline silicon. The conveying plate may alternatively be formed from a polymeric material, a composite material, glass or a metal.

Figure 2:
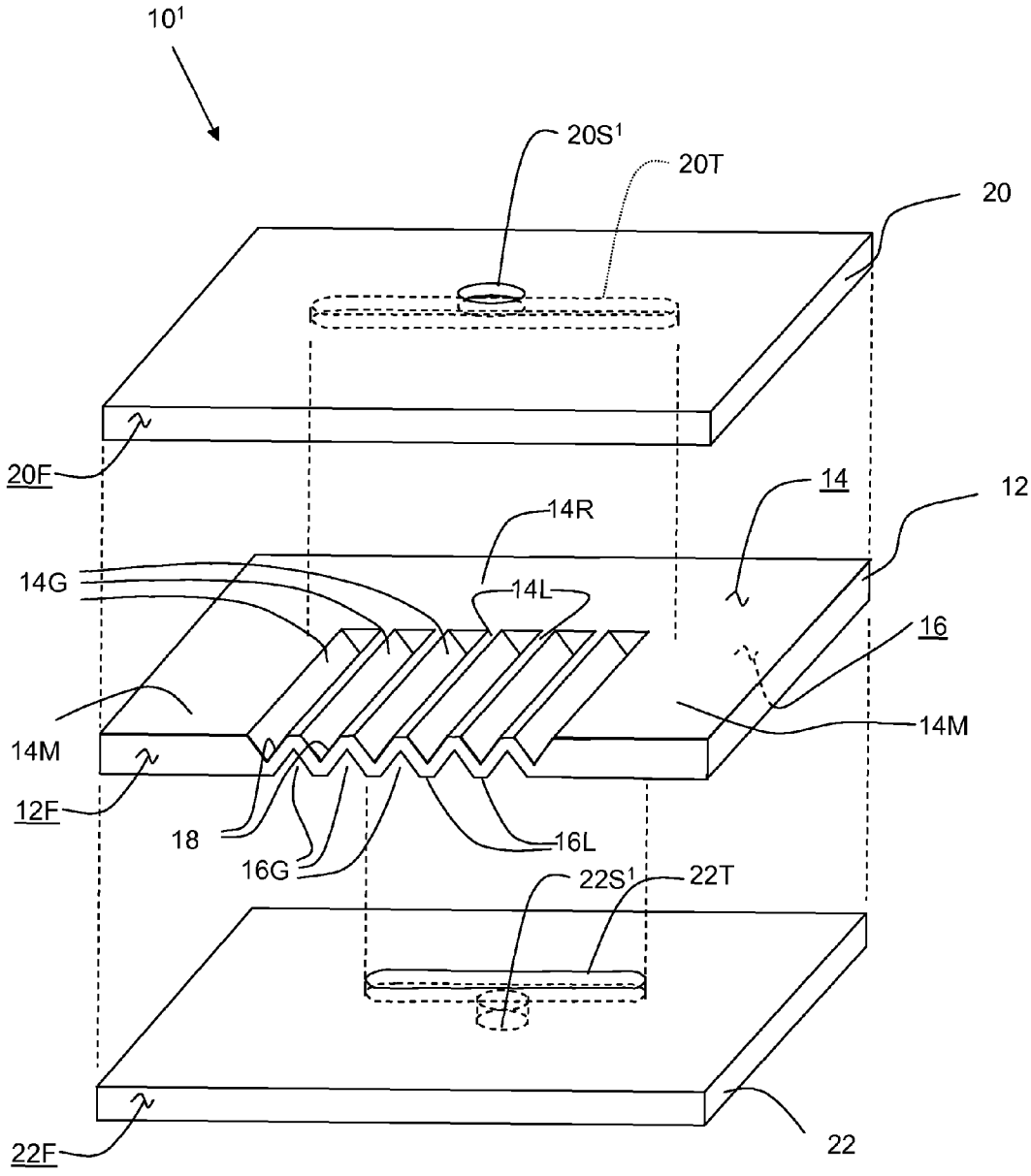
FIG. 2 is an exploded view of the stacked elements forming the mixing device of FIG. 1.

As best seen in FIG. 2 each major surface 14, 16 of the conveying plate 12 has a plurality of grooves 14G, 16G respectively formed therein. Each groove 14G, 16G on each major surface 14, 16 is separated from an adjacent groove on that surface by an intermediate land 14L, 16L, thereby to impart a substantially corrugated configuration to the conveying plate 12.

The grooved region on the major surface 14 of the conveying plate 12 is surrounded on three sides by two planar lateral margins 14M and a rear margin 14R (FIG. 2). The grooved region on the major surface 16 of the conveying plate 12 is similarly surrounded by two planar lateral margins 16M (FIG. 4) and a rear margin 16R (FIG. 5).

Figure 3:
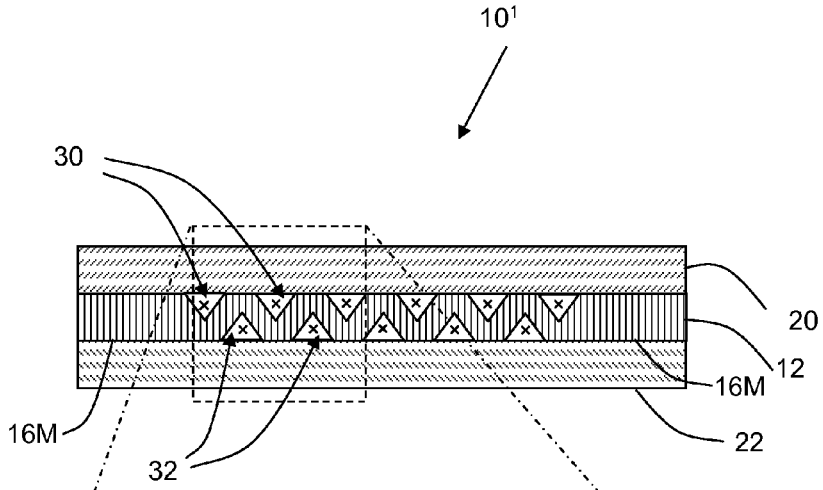
FIG. 3 is a section view taken along section lines 3-3 in FIG. 1.
Figure 3A:
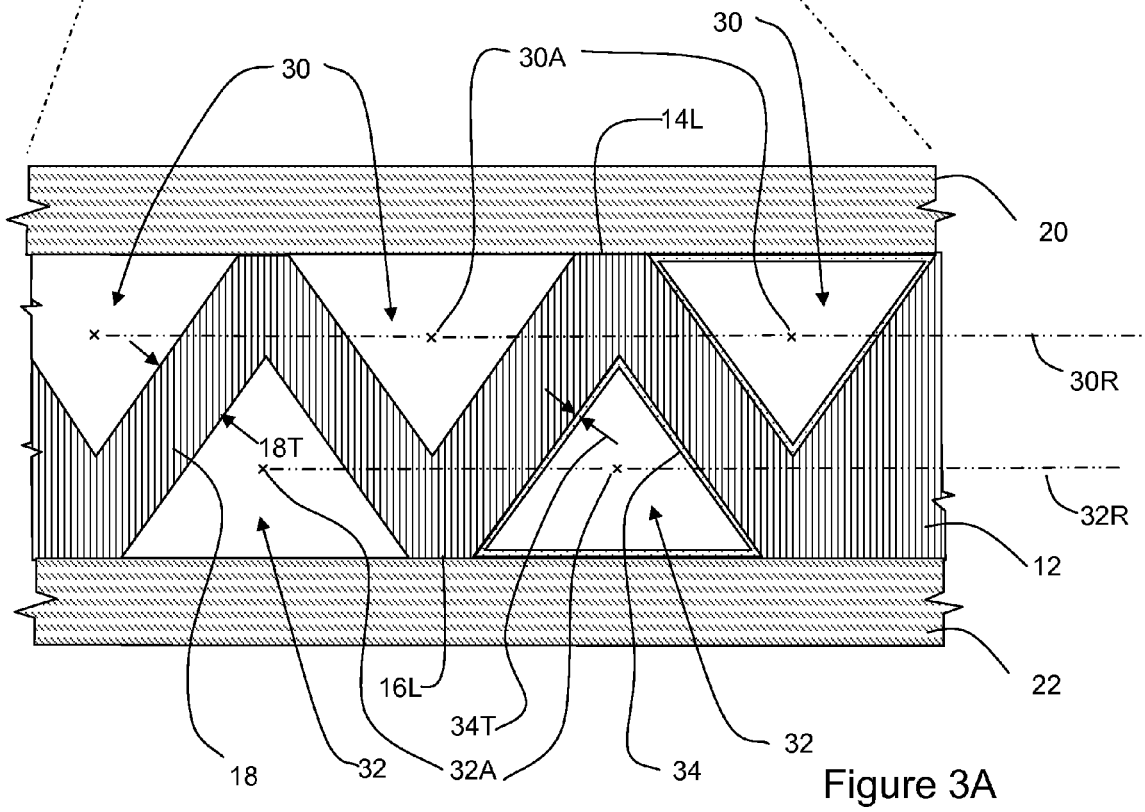
FIG. 3A is an enlarged view of the boxed portion of FIG. 3.

Adjacent grooves 14G, 16G on opposed major surfaces of the conveying plate 12 are separated laterally by a web 18 having a predetermined thickness dimension 18T (FIG. 3A).

The first and second cover plates 20, 22 respectively overlie the first and second major surfaces 14, 16 of the conveying plate 12. Each cover plate 20, 22 is disposed in contact against the margins and the lands on the major surface of the conveying plate 12 confronted by that cover plate. Thus, the cover plate 20 contacts the margins 14M, 14R and the lands 14L on the confronting major surface 14 of the conveying plate 12. Similarly, the cover plate 22 contacts the margins 16M, 16R and the lands 16L on the confronting major surface 16 of the conveying plate 12.

Each cover plate 20, 22 and the corresponding respective confronting major surface 14, 16 of the conveying plate 12 cooperate to define first and second sets of separated channels 30, 32 extending through the mixing device $\mathbf{10}^1$. As seen in FIG. 5 each channel 30, 32 has a predetermined length dimension 30L, 32L extending between its supply end 30S, 32S and its discharge end 30D, 32D. A channel axis 30A, 32A (denoted by the symbol "x" in FIGS. 3, 3A and 4) extends through each channel from its supply end to its discharge end.

The length dimension 30L, 32L of the channels may be any convenient value consistent with the overall length of the conveying plate 12. The lengths 30L of the channels 30 in the set of channels on the first surface of the conveying plate are substantially equal to each other and to the lengths 32L of the channels 32 in the set of channels on the second surface of the conveying plate.

The conveying plate 12 has a length 12L (FIG. 5) of about ten millimeters (10 mm). The width dimension of the conveying plate 12 is determined by the number of channels in the sets of channels on the opposed surfaces of the conveying plate. For the mixing device $\mathbf{10}^1$ shown in FIGS. 1 through 5 (wherein a set of six channels is disposed on the surface 14 of the conveying plate 12 while a set of five channels is disposed on the opposed surface 16) the width dimension is about ten millimeters (10 mm). It should be understood that if a larger number of channels is desired the width dimension of the conveying plate 12 would be increased commensurately. Wider channels would similarly result in an increase in the width dimension of the conveying plate 12.

The length and width of the conveying plate 12 also determines the overall length and width dimension of a mixing device $\mathbf{10}^1$ as well as the various other embodiments of the mixing device 102 (FIGS. 11, 12) and $\mathbf{10}^3$ (FIGS. 13, 14) to be described herein.

Figure 6:
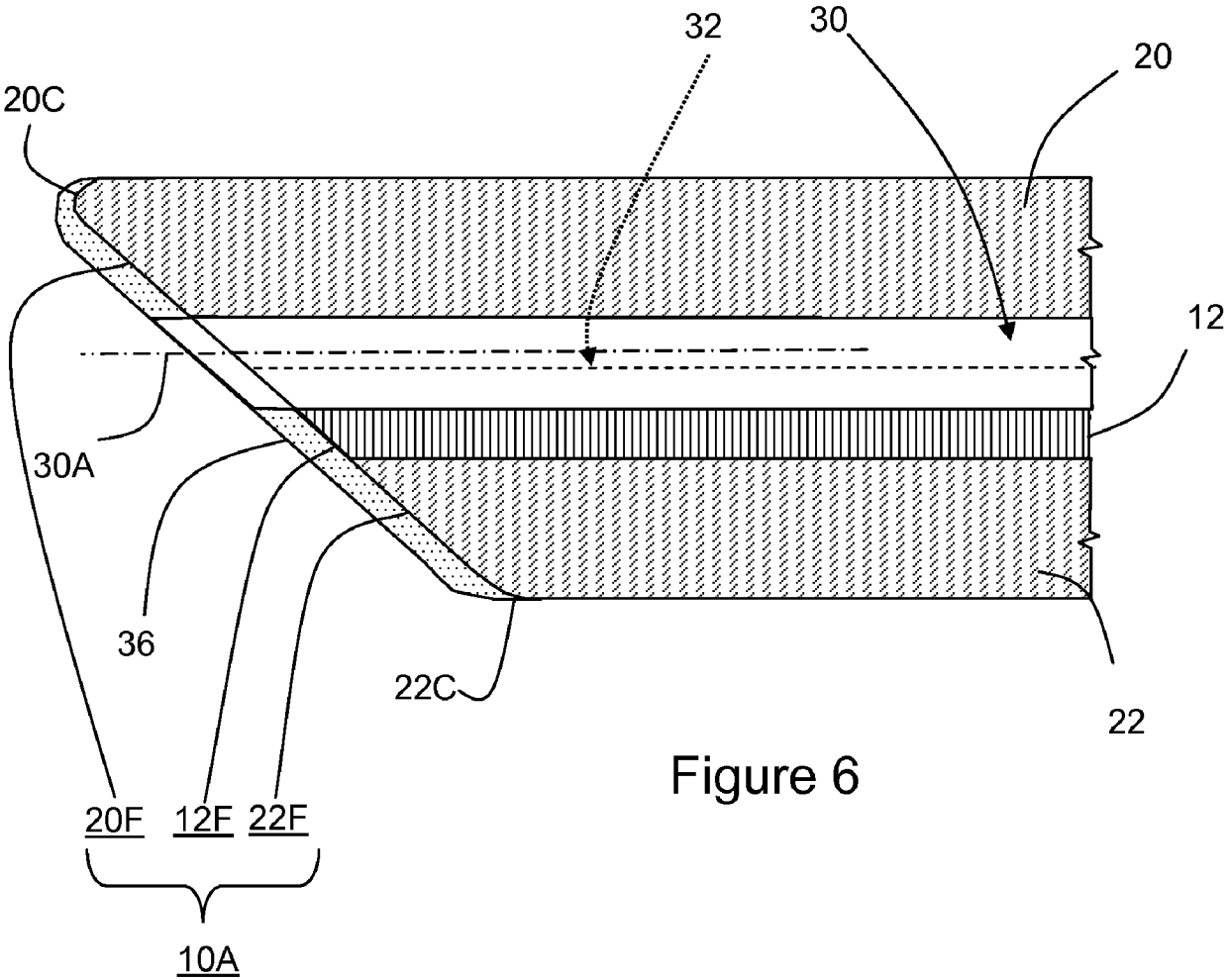
FIG. 6 is a section view showing an alternative configuration of the front portion of the mixing device shown in FIGS. 4 and 5, taken along section lines 6-6 in FIG. 4.

As best seen in FIG. 5 the anterior surface 10A of the mixing device $\mathbf{10}^1$ (defined by the coplanar front edge surfaces 20F, 22F and 12F) is perpendicular to the channel axes 30A, 32A. However, as shown in FIG. 6, the anterior surface 10A may be inclined with respect to the channel axes 30A, 32A. It should be noted that either arrangement (i.e., perpendicularity or inclination of the anterior surface 10A to the axes) may be used with any other embodiment $\mathbf{10}^2$, $\mathbf{10}^3$ of the mixing device.

As also suggested in FIG. 6 one or both of the corners 20C, 22C of the front edge surfaces 20F, 22F may be rounded.

The channels 30, 32 are arranged such that their discharge ends are interdigitated (FIGS. 1, 3, 3A and 4). By "interdigitated" it is meant that the discharge end 30D of each channel 30 is next adjacent to the discharge end 32D of at least one of the channels 32.

The thickness dimension 18T of the webs 18 (FIG. 3A) is preferably the minimum thickness consistent with the material of construction of the conveying plate 12 so that the spacing between adjacent channels is as close as possible. A thickness dimension 18T of about ten to one hundred (10-100) micrometers is preferred.

As will be developed, when in use, this interdigitated arrangement between next-adjacent discharge ends 30D, 32D of closely adjacent channels places one component of an adhesive emanating from a channel 30 in laterally adjacent contact with the other component of the adhesive emanating from a channel 32. Adhesive components emanating from laterally adjacent channels on opposite surfaces of the conveying plate diffuse together to achieve diffusion mixing.

In the mixing device $10^1$ shown in FIGS. 1 through 5 the axes 30A of the channels 30 are parallel to each other. These axes 30A are also illustrated as coplanar with each other (i.e., they lie in a common plane 30R, FIG. 3A). Similarly, the axes 32A of the channels 32 are also parallel to each other and are also arranged to lie on a common plane 32R. In addition, the axes 30A of the channels 30 are parallel to the axes 32A of the channels 32.

As shown in FIGS. 7A, 7B, 7C and 7D other arrangements of the channel axes are possible while maintaining the interdigitated relationship at the discharge ends 30D, 32D of the channels. Any of these alternative arrangements of the channel axes may be used with any of the embodiments $10^1$, $10^2$, or $10^3$ of the mixing device of the present invention.

Figure 7A:
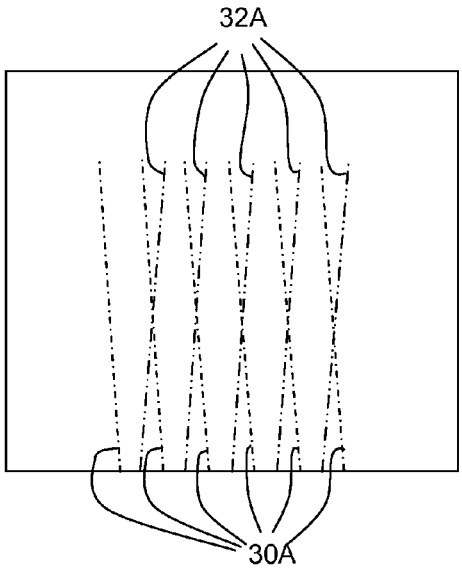
FIGS. 7A, 7B, 7C and 7D are stylized plan views showing alternative arrangements of the axes of channels on the same major surface of a conveying plate, as well as alternative arrangements of the axes of channels on that major surface relative to the axes of channels on the other major surface of the conveying plate.

In FIG. 7A the axes 30A of the channels 30 on the major surface 14 are parallel to each other while the axes 32A of the channels 32 on the major surface 16 are parallel to each other. However, each of the axes 30A is oriented at an acute angle with respect to each of the axes 32A.

Figure 7B:
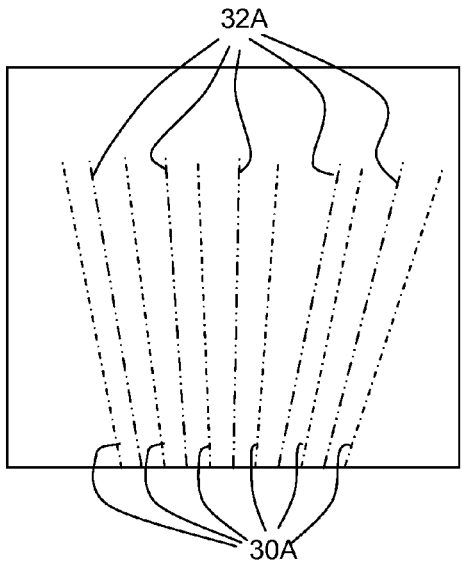

FIG. 7B shows an arrangement in which the axes 30A of the channels 30 are oriented at acute angles with respect to each other. Similarly, the axes 32A of the channels 32 are also oriented at acute angles with respect to each other. However, the axes 30A, 32A are not arranged in parallel, although pairs of axes 30A, 32A could be parallel to each other, if desired.

Figure 7C:
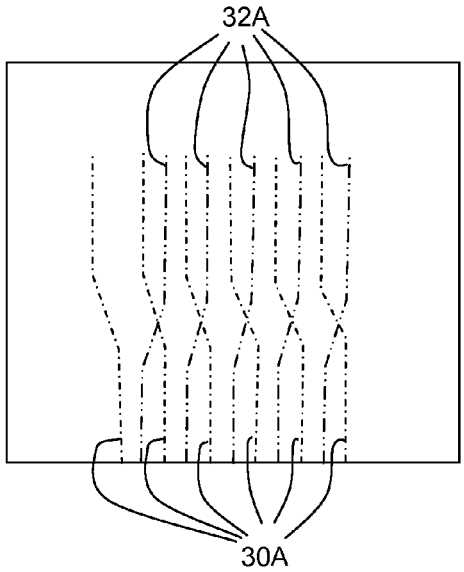
Figure 7D:
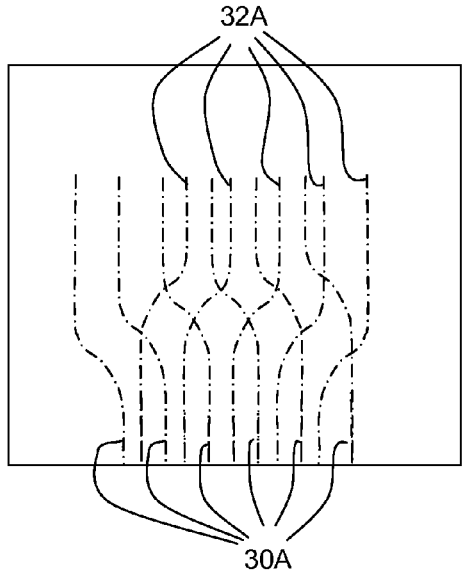

FIGS. 7C and 7D show arrangements in which the axes 30A, 32A are not straight. In FIG. 7C the axes 30A, 32A are piece-wise linear. In FIG. 7D the axes 30A, 32A include a curved section.

It may be the case that one or both of the component(s) of the adhesive exhibit(s) an affinity for the material of either the conveying plate or the cover plate. Accordingly, it may be desirable to treat the surfaces of the channels 30, 32 so that they lack affinity for (i.e., repel) an adhesive component. Accordingly, as shown in FIG. 3A, in the preferred instance the grooved portions of each major surface of the conveying plate 12 and the overlying portions of the surfaces of the cover plates 20, 22 have a siloxane-containing layer 34 provided thereon. The layer 34 has a thickness 34T. The thickness 34T is preferably less than ten (10) micrometers. A preferred siloxane-containing material is the siliconizing fluid sold by Thermo Fisher Scientific Inc., Rockford, Ill. under the trademark "SurfaSil"™.

A siloxane-containing layer 36 may also be provided on the anterior surface 10A (FIGS. 5 and 6) of the mixing device. The same siloxane-containing material used to treat the surfaces of the channels 30, 32 may be used.

Each channel in the first and second sets of channels 30, 32 has a predetermined cross-sectional area measured in a plane perpendicular to the axis extending therethrough.

Assuming equal adhesive component flow velocities the ratio of the cross sectional area of a channel 30 in the first set to the cross sectional area of a channel 32 in the second set determines the ratio of the volumes of the first and second components of the dispensed adhesive.

In FIGS. 3 and 3A the cross sectional areas of channels 30 and 32 are substantially equal, resulting in substantially equal volumes of adhesive components emanating from the discharge ends 30D, 32D. However, if different dispensed volumes of adhesive components are desired the cross sectional areas of channels 30 and 32 may be different from each other, as shown FIG. 8.

Figure 8:
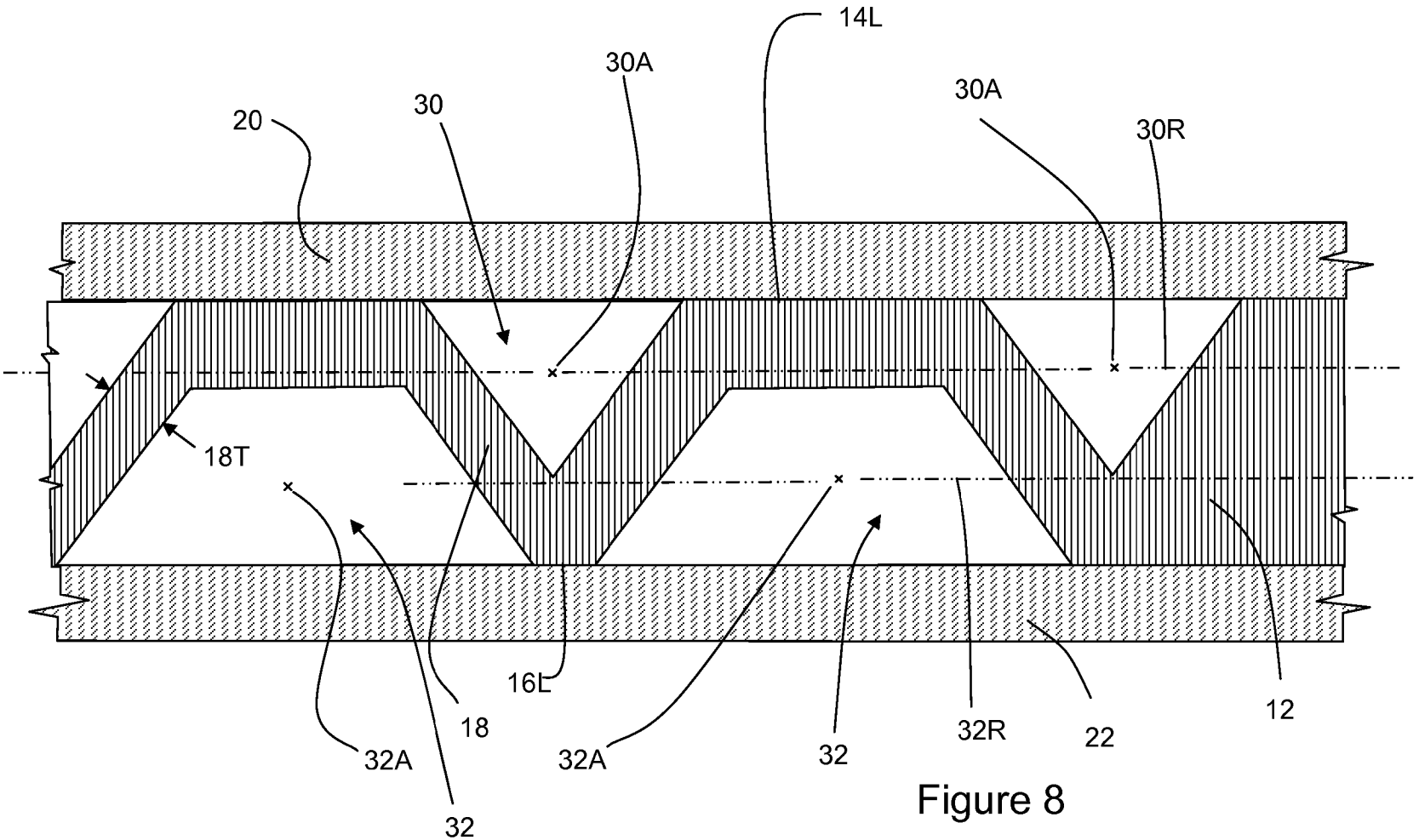
FIG. 8 is an enlarged section view similar to FIG. 3A showing an alternative channel arrangement wherein the channels have different cross sectional areas.

Channels may also have different cross sectional shapes. For example, as also seen in FIG. 8, the channels 30 (and/or 32) may be triangular (approximating equilateral) in cross sectional shape. Alternatively, the channels 32 (and/or 30), may be trapezoidal in cross sectional shape. These triangular and/or trapezoidal shapes result when the conveying plate 12 is fabricated by etching <100> crystalline silicon. Other cross sectional shapes, such as rectangular or semicircular, may be produced when different materials and/or different fabrication methods are employed.

Any of these alternative relationships among channel size and/or shape may be used with any of the embodiments $10^1$, $10^2$, or $10^3$ of the mixing device of the present invention.

A typical thickness dimension for a silicon conveying plate 12 is about three hundred to five hundred (300 to 500) micrometers. For triangular channels (such as channel 30 in FIG. 8) typical leg dimensions of the triangle are about two hundred to three hundred fifty (200 to 350) micrometers. For trapezoidal channels (such as channel 32 in FIG. 8) the widths of the channels, as measured along the longer of the two parallel sides of the trapezoid, are up to five hundred (500) micrometers. Channel depths, as measured between the two parallel sides of the trapezoid, are typically about two hundred to three hundred (200 to 300) micrometers.

Figure 4:
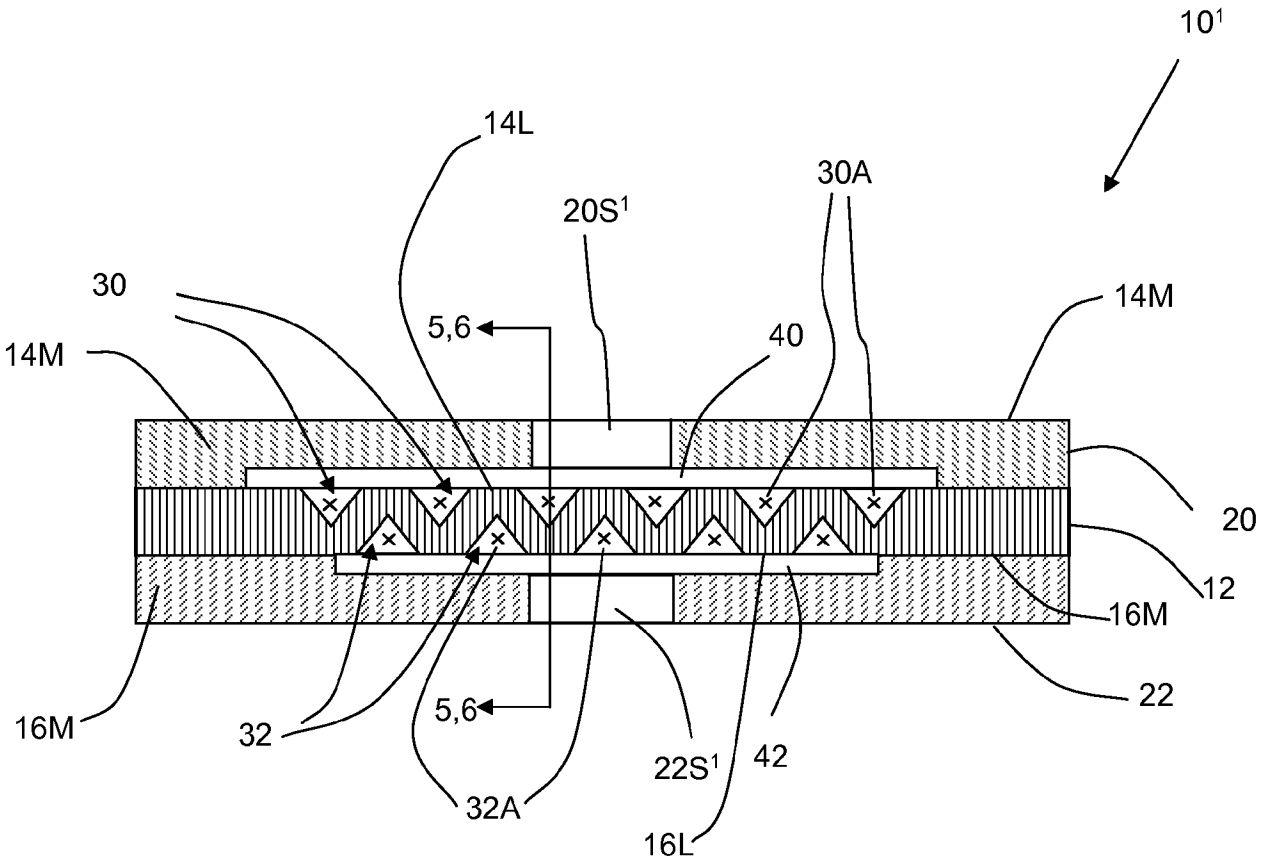
FIG. 4 is a section view taken along section lines 4-4 in FIG. 1.

Each of the cover plates 20, 22 and a respective major surface 14, 16 of the conveying plate 12 cooperate to define a first and a second distribution manifold 40, 42 within the mixing device 101 (FIGS. 1, 4 and 5).

Each distribution manifold 40, 42 respectively communicates with the supply end 30S, 32S of the first and second sets of channels 30, 32 regardless of how the channels are arranged, sized or shaped. In general the cross sectional areas of the channels 30, 32 should be sufficiently small such that distribution manifolds formed within the mixing device (to be described) fill prior to the occurrence of any flow through the channels.

Figure 9:
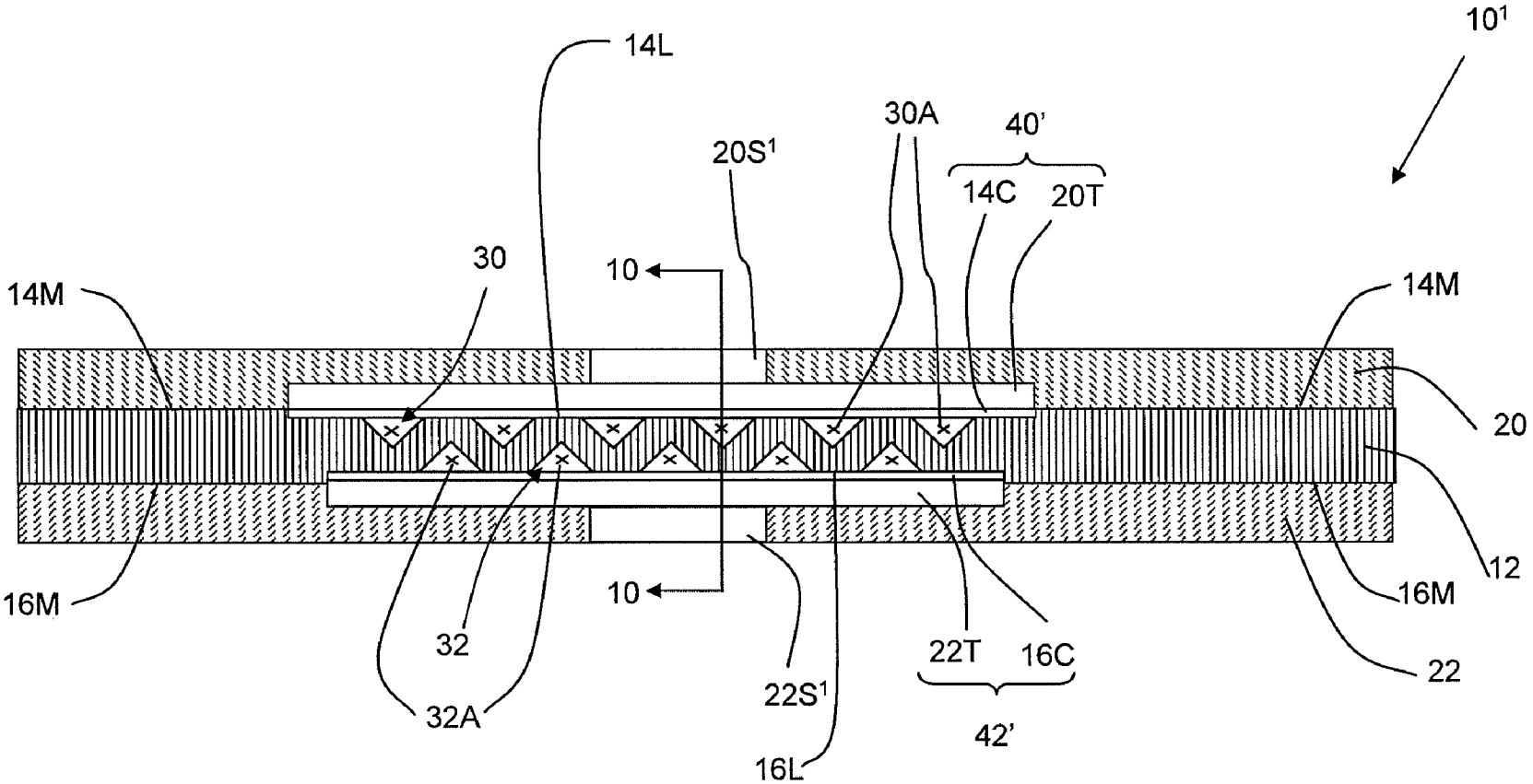
FIG. 9 is a section view generally similar to FIG. 4 showing an alternative manifold arrangement in which the conveying plate has a cavity therein.
Figure 10:
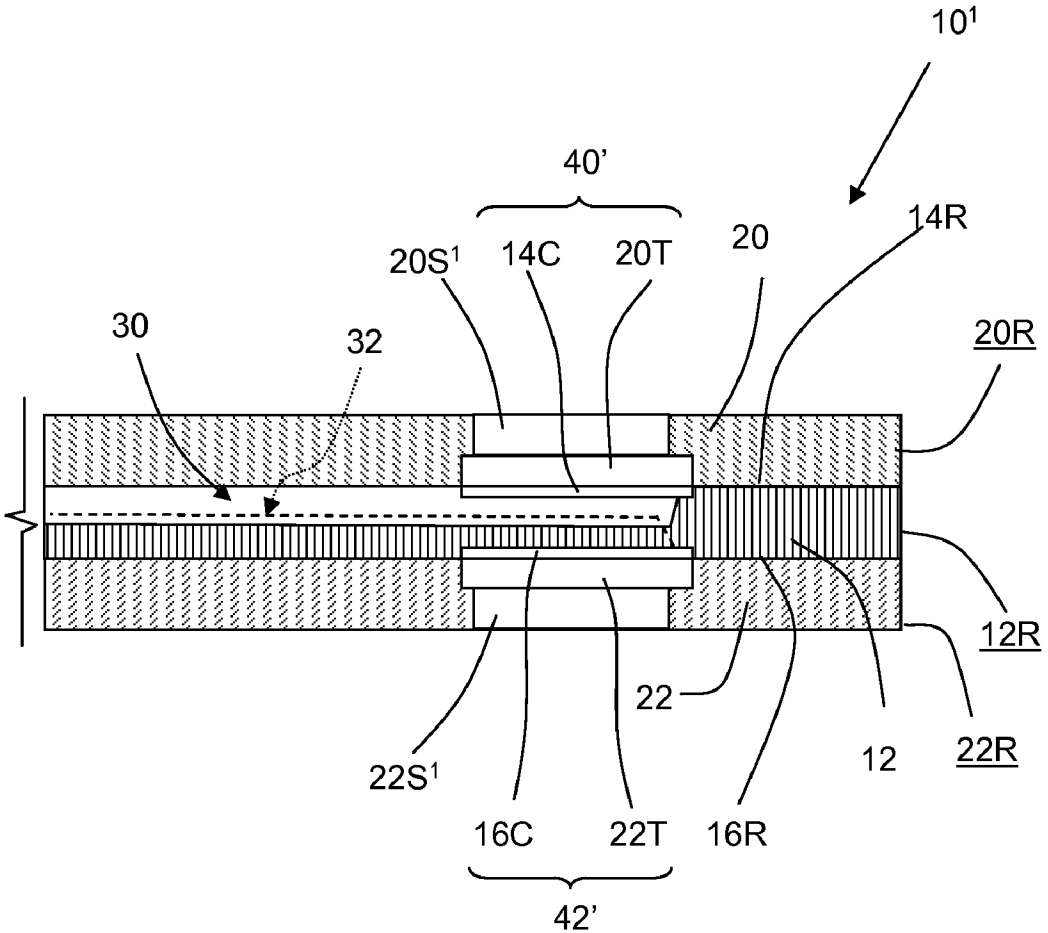
FIG. 10 is a section view taken along section lines 10-10 of FIG. 9 with the frontal portion of FIG. 10 being omitted for clarity.

In the embodiment of the mixing device $10^1$ illustrated in FIGS. 1 through 5 each distribution manifold 40, 42 is defined by a recess 20T, 22T (FIG. 2) provided in each cover plate 20, 22. As an alternative, as shown in FIGS. 9 and 10, one or both of the major surface(s) of the conveying plate 12 may also have a cavity 14C, 16C formed therein. The cavity(ies) 14C, 16C in one or both of the major surfaces of the conveying plate 12 cooperate with the recess(es) 20T, 22T formed in the respective confronting cover plates to define enlarged distribution manifolds 40', 42' in the mixing device $10^1$. Enlarged distribution manifolds 40', 42' may be similarly formed in other embodiments $10^2$, $10^3$ of the mixing device, if desired.

Supply ports are provided to enable introduction of respective components of an adhesive into each distribution manifold (however it is configured). As will be developed the various dispositions of the supply ports define different embodiments of the mixing device and a dispensing apparatus employing the same.

In the case of the mixing device $10^1$ a supply port 20S', 22S' extends in opposed fashion through each respective opposed cover plate 20, 22 into each distribution manifold 40, 42 (FIGS. 4 and 5) or respective enlarged distribution manifold 40', 42' (FIGS. 9 and 10) as the case may be. The ports 20S', $22S^1$ could be formed using any suitable expedient, such as machining or etching.

Figure 11:
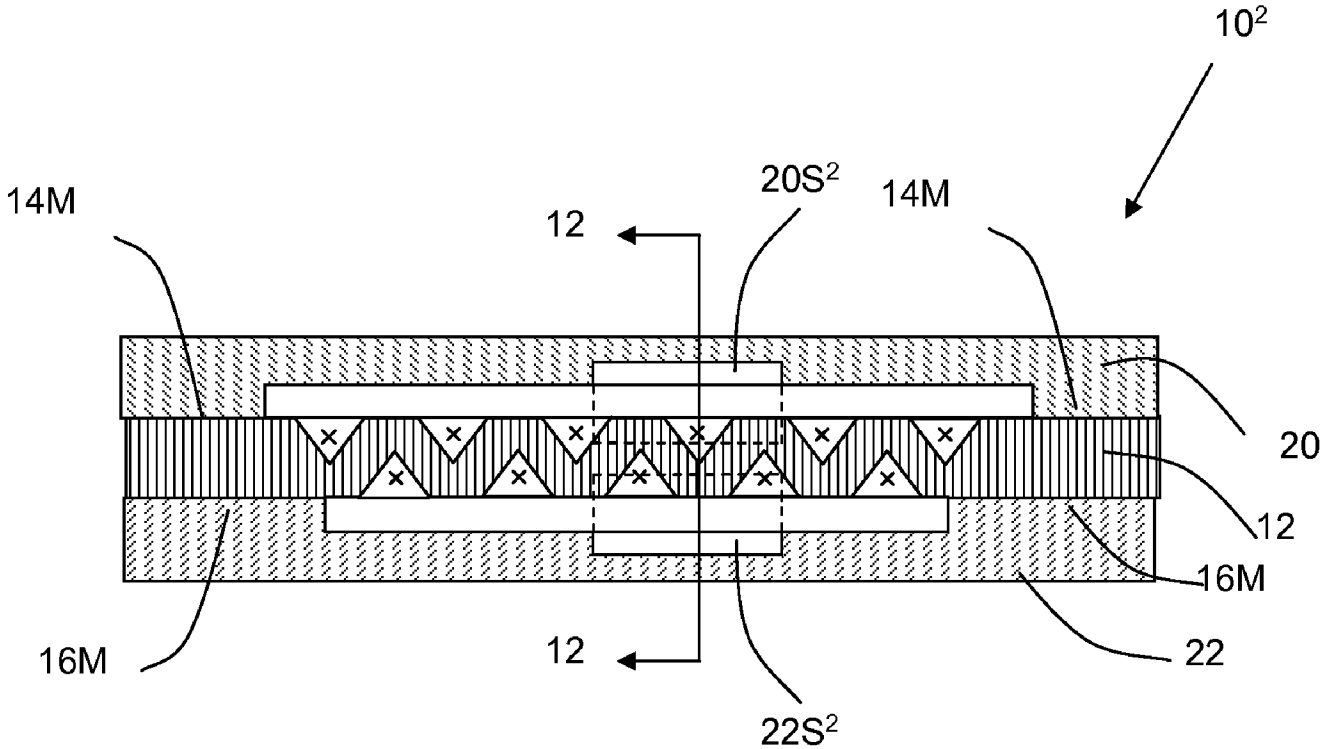
FIG. 11 is a section view generally similar to FIG. 4 showing a mixing device having rearwardly positioned supply ports in accordance with an alternative embodiment of the present invention.
Figure 12:
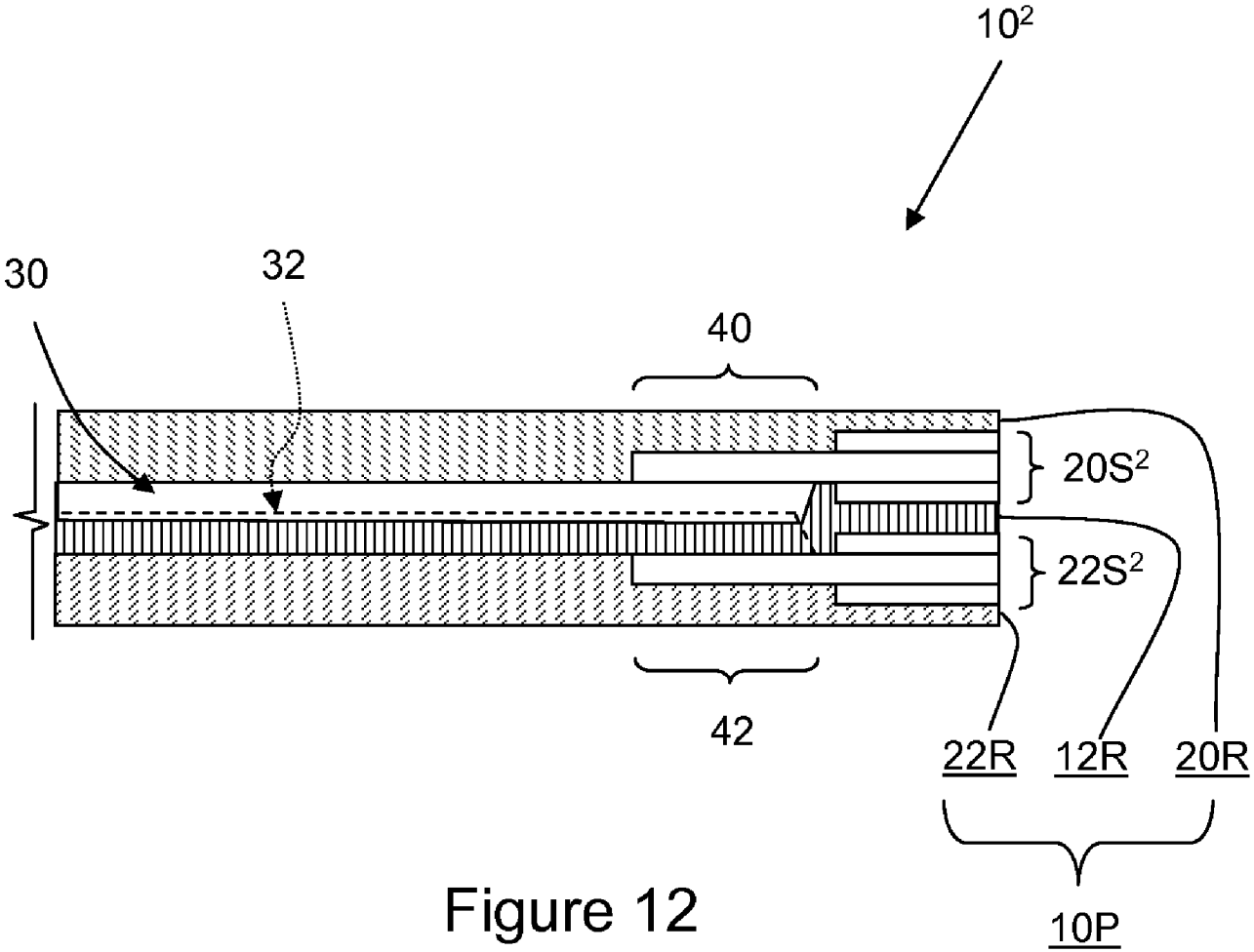
FIG. 12 is a section view taken along section lines 12-12 of FIG. 11 with the frontal portion of FIG. 12 being omitted for clarity.

In the alternative embodiment shown in FIGS. 11 and 12 each supply port $20S^2$, $22^S$ is rearwardly positioned in the mixing device $10^2$ to extend through the posterior surface $10^2$P thereof into communication with a respective distribution manifold 40, 42 (or 40', 42'). As illustrated each supply port $20S^2$, $22S^2$ is formed in a respective cover plate 20, 22 and in the conveying plate 12. Alternatively, each supply port $20S^2$, $22S^2$ may be formed entirely in the respective cover plates 20, 22. Any suitable technique for forming the supply ports 20$S^2$, 22$S^2$ may be used.

Figure 13:
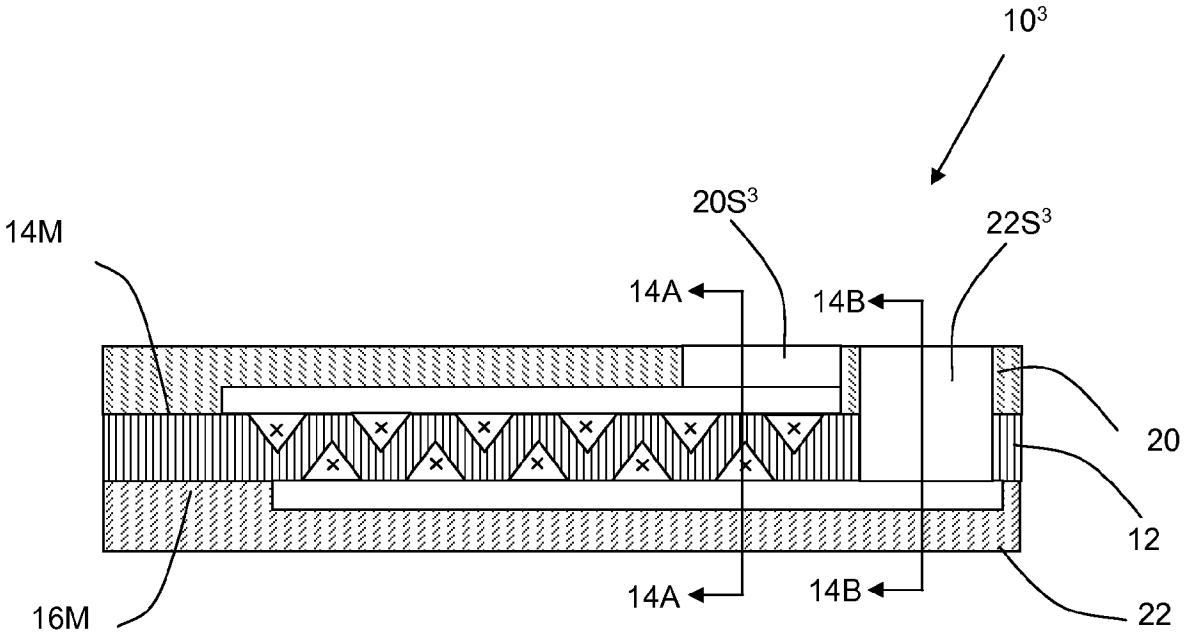
FIG. 13 is a section view generally similar to FIG. 4 showing a mixing device having laterally adjacent supply ports in accordance with another alternative embodiment of the present invention in which both supply ports extend through the same cover plate.
Figure 14A:
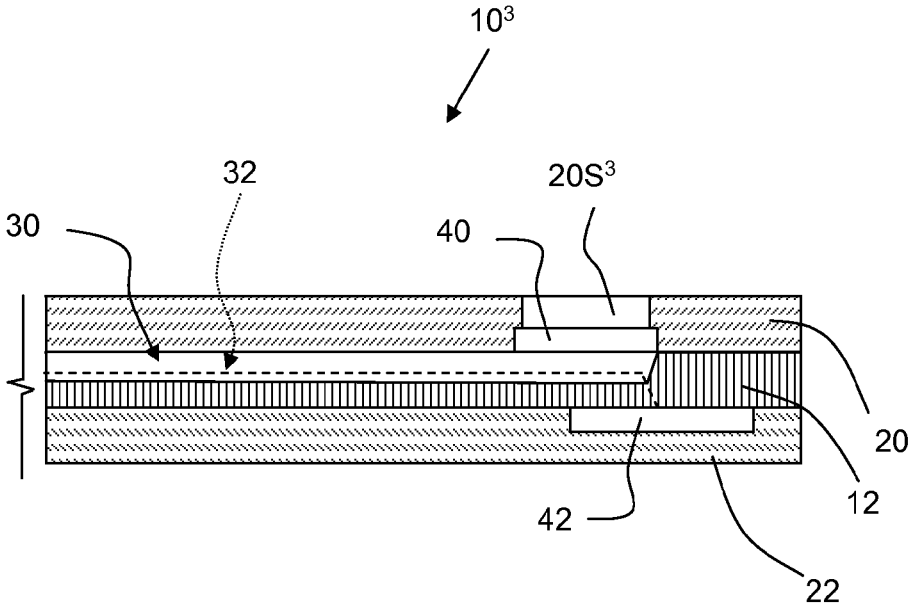
FIGS. 14A and 14B are section views, respectively taken along section lines 14A-14A and 14B-14B of FIG. 13.
Figure 14B:
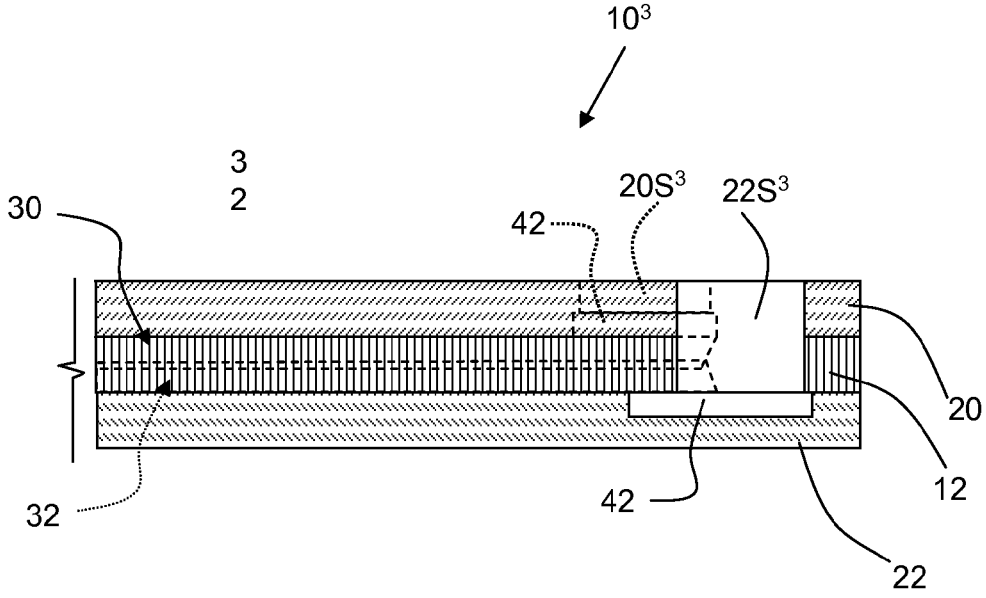

FIGS. 13 and 14 illustrate yet another alternative embodiment of the mixing device 1 in which both supply ports 20$S^3$, 22$S^3$ are laterally adjacent to and isolated from each other and extend through the same cover plate. The supply port 20$S^3$ is formed through the cover plate 20 and extends into the distribution manifold 40 (or 40'). The supply port 22$S^3$ extends through both the cover plate 20 and the conveying plate 12 into the distribution manifold 42 (or 42'). It is noted that to accommodate this laterally adjacent positioning of the supply ports 20$S^3$, 22$S^3$ in this embodiment the manifolds 40, 42 (or 40', 42') must be offset from each other by a sufficient distance. The offset distance can extend side-to-side and/or front-to-back, as suggested in FIGS. 13, 14A, 14B and 17.

-o-0-o-

A dispenser apparatus 110$^1$, 110$^2$ or 110$^3$ incorporating any of the embodiments of the respective mixing device 10$^1$, 10$^2$ or 10$^3$ also lies within the contemplation of the present invention.

In each case the dispenser apparatus 110$^1$, 110$^2$ or 110$^3$ includes a header 50$^1$, 50$^2$ or 50$^3$ that is connected to the mixing device. Each header 50$^1$, 50$^2$ or 50$^3$ has a first and a second passage extending therethrough. By "connected" it is meant that the header is physically abutted in a fluid-tight manner against the mixing device such that passages in the header are disposed in fluid communication with the supply ports in the mixing device. The connection between the header 50$^1$, 50$^2$ or 50$^3$ and its associated mixing device 10$^1$, 10$^2$ or 10$^3$ is effected by physically attaching the header to an appropriate location on the mixing device.

The attachment of the header to the mixing device may be non-removable or removable. If it is contemplated that the mixing device be utilized only once within the dispenser, then it is desirable that the attachment of the mixing device to the header be made in a removable manner. The header may then be cleaned for reuse.

Figure 15:
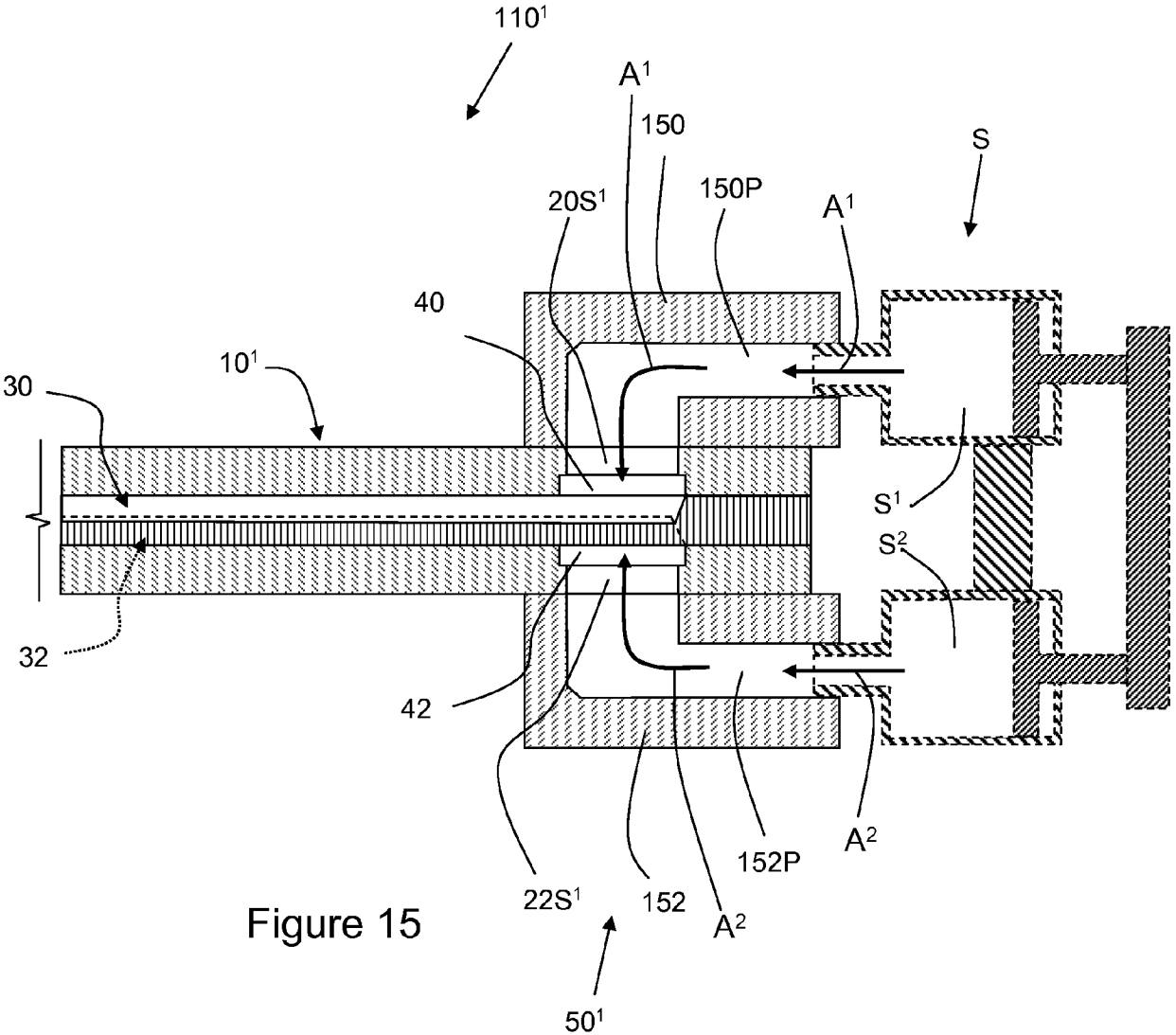
FIG. 15 is a section view of an adhesive dispenser apparatus incorporating the embodiment of the mixing device as shown in FIGS. 1 through 5.

FIG. 15 is a section view of a dispenser apparatus generally indicated by reference character 110$^1$ incorporating the embodiment of the mixing device 10$^1$ shown in FIGS. 1 through 5.

The dispenser apparatus 110$^1$ includes the header 50$^1$ comprised of a first and a second header block 150, 152. The header blocks may be physically discrete (as shown) or conjoined. Each header block 150, 152 is respectively connected to the first and second cover plates 20, 22. Each header block 150, 152 has a passage 150P, 152P formed therein. By virtue of the connection each passage 150P, 152P is disposed in fluid communication with one of the respective supply ports 20$S^1$, 22$S^1$ formed in the mixing device 10$^1$. A component of an adhesive is thus able to be introduced into a passage 150P, 152P in a header block 150, 152, through the respective supply port 20$S^1$, 22$S^1$, and into the respective distribution manifold 40, 42 (or 40', 42').

In this embodiment the header blocks 150, 152 are preferably physically attached to the respective first and second cover plates 20, 22 using any suitable attachment process consistent with the materials of construction of the headers and the cover plates. In an arrangement where the headers and the cover plates made of glass or fused quartz, an ultraviolet cured epoxy has been found suitable to attach permanently these members. If the headers and cover plates are made of silicon they may be fusion bonded together. If the headers and cover plates are made of a polymer material they may be ultrasonically bonded or welded together. The physical attachment preferably occurs on the major surfaces of the cover plates.

Alternatively, a removable mechanical attachment arrangement (e.g., a clamping arrangement) may be used to attach headers and cover plates made from any materials.

Figure 16:
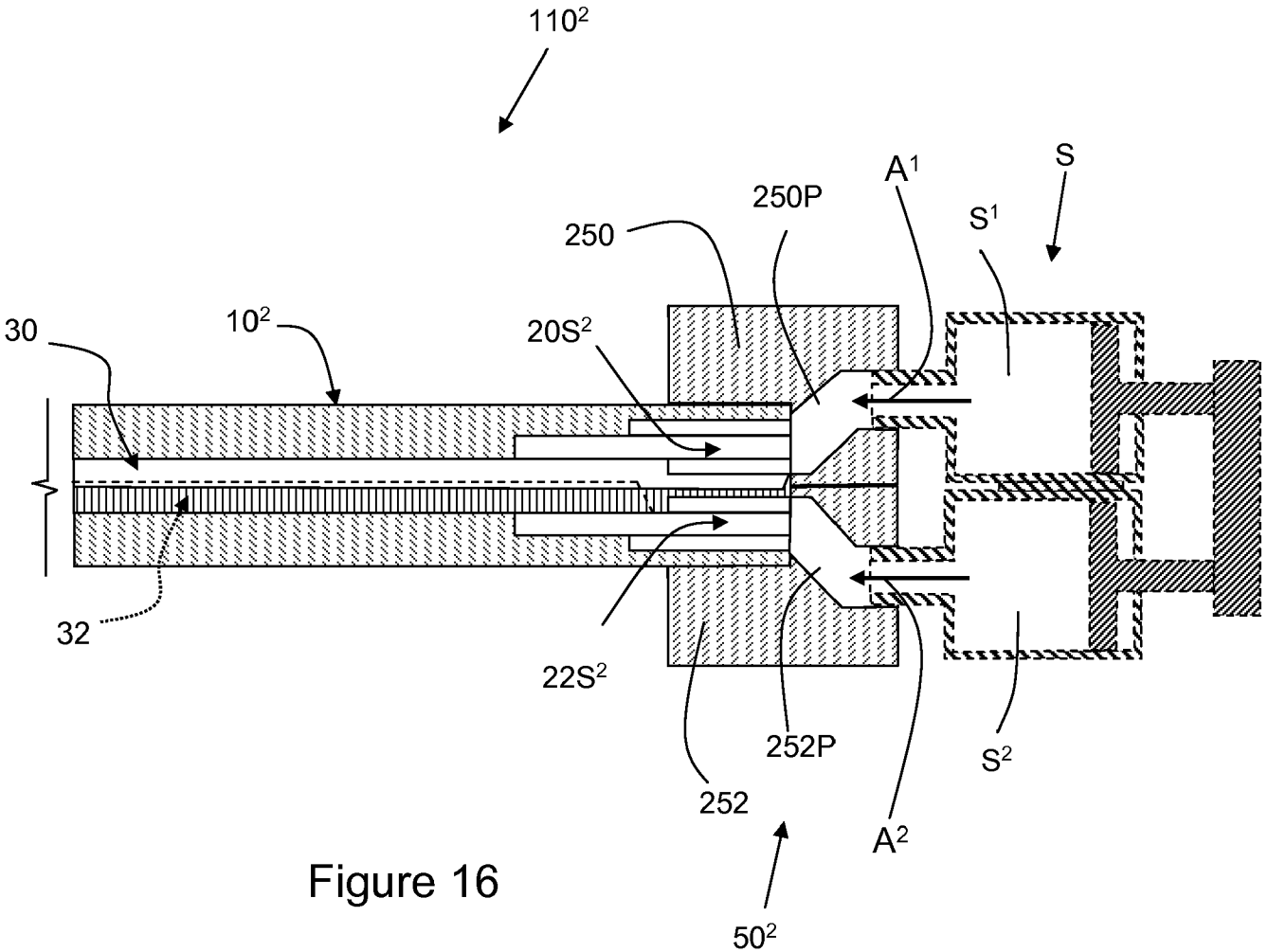
FIG. 16 is a section view of an adhesive dispenser apparatus incorporating the embodiment of the mixing device as shown in FIGS. 11 and 12.

The second embodiment of the dispenser apparatus 110$^2$ shown in FIG. 16 utilizes the mixing device 10$^2$ illustrated in FIGS. 11 and 12. The dispenser apparatus 110$^2$ includes a header 50$^2$ connected to the posterior surface of the mixing device 10$^2$.

In this instance the header 50$^2$ comprises a first and a second header block 250, 252. The blocks 250, 252 are conjoined along planar contacting surfaces. Each header block 250, 252 has a respective passage 250P, 252P formed therein. The passages 250P, 252P are respectively disposed in fluid communication with the first and second supply ports 20$S^2$, 22$S^2$.

As previously described in conjunction with FIGS. 11 and 12 the supply ports 20$S^2$, 22$S^2$ pass through the respective rear surfaces 20R, 22R of the cover plates 20, 22. A component of an adhesive is thus able to be introduced into a passage 250P, 252P in the header 250, 252 through the respective supply port 20$S^2$, 22$S^2$, and into the respective distribution manifold 40, 42 (or 40', 42').

In this arrangement the header blocks 250, 252 are physically attached to at least the rear surface 12R of the conveying plate 12 and to the rear surfaces 20R, 22R, respectively, of the first and second cover plates 20, 22. The blocks 250, 252 may also be physically attached to the major surfaces of the cover plates 20, 22. These physical attachments may be effected in the same manner as discussed in connection with FIG. 15.

Figure 17:
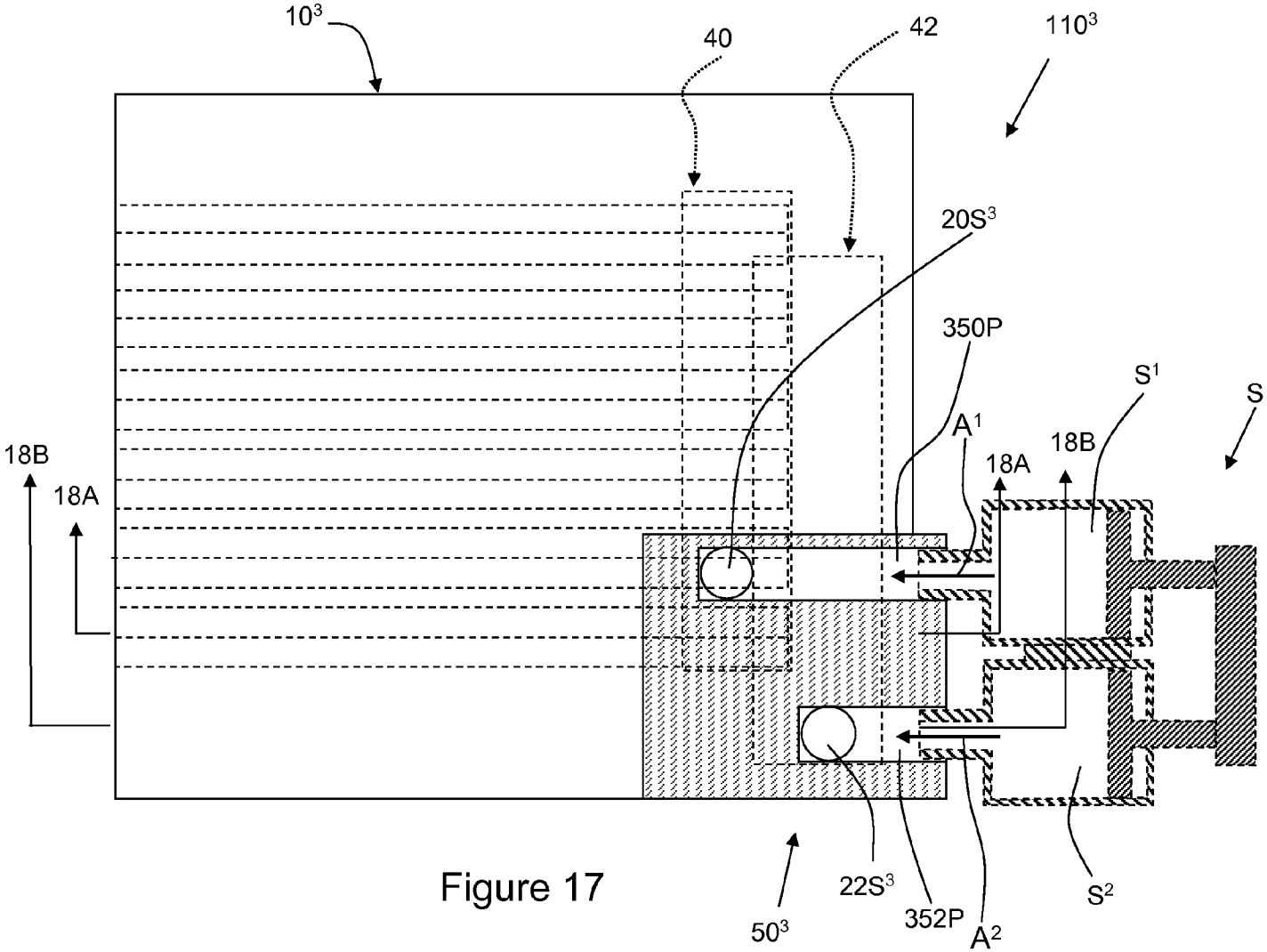
FIG. 17 is a section view of an adhesive dispenser apparatus incorporating the embodiment of the mixing device as shown in accordance with FIGS. 13, 14A and 14B, the view being taken along section lines 17-17 of FIGS. 18A and 18B.
Figure 18A:
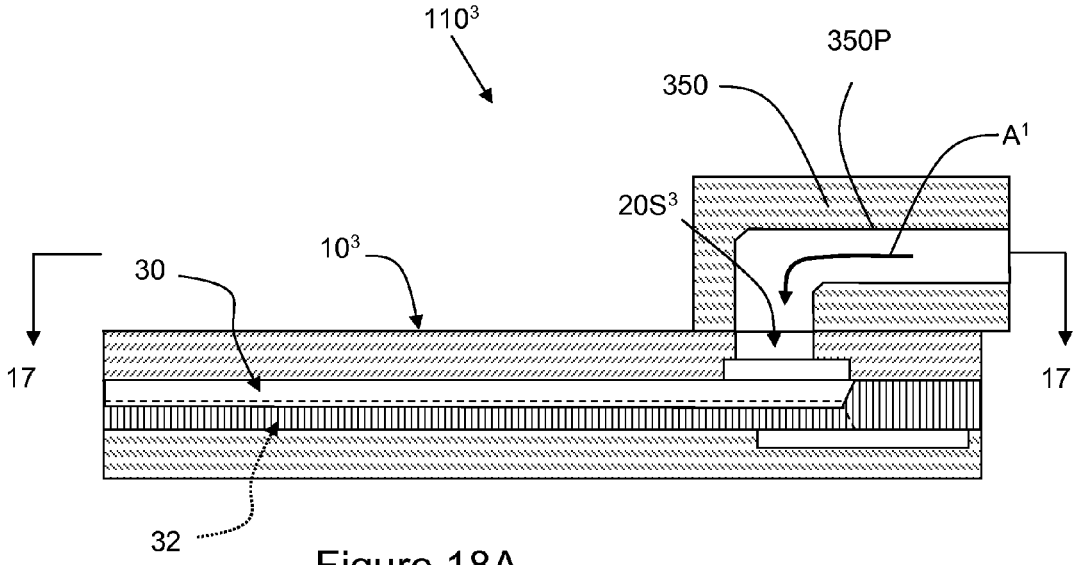
FIGS. 18A and 18B are section views respectively taken along section lines 18A-18A, 18B-18B of FIG. 17.
Figure 18B:
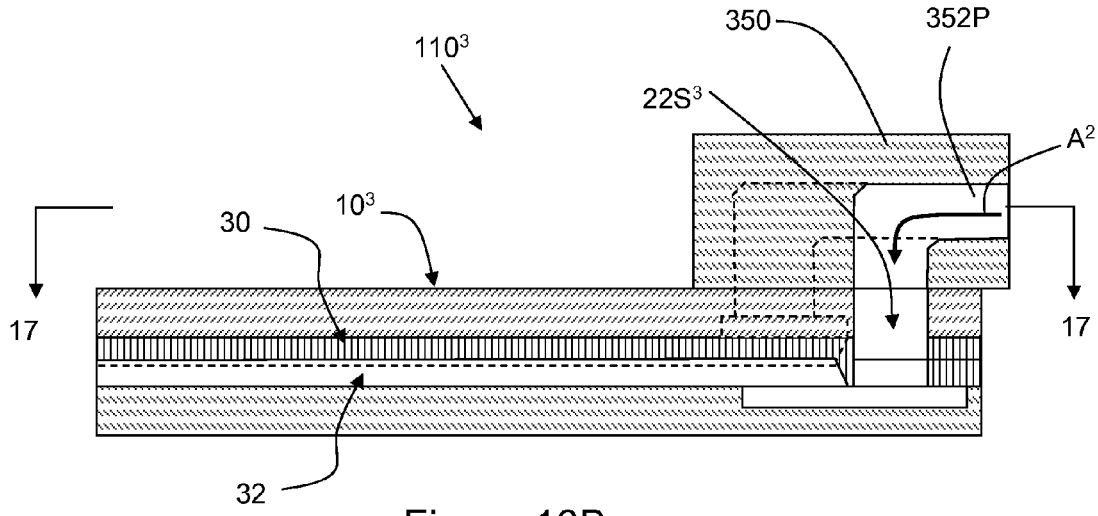

The third embodiment of the dispenser apparatus 110$^3$ is shown in FIGS. 17, 18A and 18B. This third embodiment 110$^3$ utilizes the mixing device 10$^3$ shown in FIGS. 13 and 14. The dispenser apparatus 110$^3$ includes a header 50$^3$ connected to the first cover plate 20. The header 50$^3$ comprises a unitary header block 350.

The header block 350 has a first passage 350P and a second passage 352P formed therein. The passage 350P is disposed in fluid communication with the first supply port 20$S^3$ in the cover plate 20. The passage 352P is disposed in fluid communication with the second supply port 22$S^3$. The second supply port 22$S^3$ passes through the first cover plate 20 and the conveying plate 12 and is isolated from the first supply port 20$S^3$ and the first manifold 40 (or 40').

The header block 350 is physically attached to the cover plate 20 using any of the attachment expedients discussed above.

A first component of an adhesive is thus able to be introduced into the passage 350P in the header 350, through the supply port 20$S^3$, and into the distribution manifold 40 (or 40'). A second component of an adhesive is thus able to be introduced into the passage 352P in the header 350, through the supply port 22$S^3$, and into the distribution manifold 42 (or 42').

In use, the components of an adhesive are introduced from a supply unit generally indicated by the reference character S into a respective passage in the header 50$^1$, 50$^2$, 50$^3$ of the dispenser 110$^1$, 110$^2$, 110$^3$, as the case may be. The supply unit S has chambers $S^1$ and $S^2$, each of which holds one of the adhesive components.

Each adhesive component responds to a motive force imposed thereon by flowing from its respective chamber $S^1$ and $S^2$ into a respective passage in the header 50$^1$, 50$^2$, 50$^3$. The motive force is preferably provided by a positive displacement mechanism so that equal volumes of adhesive components flow into the mixing device $10^1$, $10^2$, $10^3$ from the chambers $S^1$ and $S^2$ of the supply unit S.

The components then pass through the respective supply ports and into the respective distribution manifold 40, 42 (or 40', 42'). The flow direction of each component is illustrated by respective flow arrows $A^1$ and $A^2$.

The cross-sectional area of each of the channels 30, 32 in the mixing device $10^1$, $10^2$, $10^3$ is sufficiently small compared to the cross-sectional area of the manifolds so that the manifolds completely fill before any of the adhesive components flow through the channels. Continued application of the motive force causes the adhesive components to flow through the channels from the respective supply ends 30S, 32S to the discharge ends 30D, 32D.

It is desirable that the adhesive components arrive at the discharge ends 30D, 32D of the channels concurrently, regardless of the volume ratios of components to be dispensed. Having the adhesive components emerging from the discharge ends 30D, 32D concurrently insures that mixing of the components will begin immediately. Concurrent emergence of the adhesive components also obviates the need for wiping the discharge end of the mixing device to remove any prematurely dispensed component of the adhesive.

For applications that require equal volumes of each adhesive component (i.e., a volume ratio of 1.0) it is important that the total of the volume in each pathway through the mixing device 10 be equal.

The volume of each pathway is determined by the sum of volumes of each pathway segment (i.e., the respective header passages; the supply ports; the manifolds and the channels). As noted the volume of each channel is determined by the cross-sectional area and the length of that channel. Thus, for such an application (assuming equal volumes in the other pathway segments) the channels 30, 32 should have equal cross-sectional areas and equal channel lengths 30L, 32L.

For applications that require component ratios other than 1.0 the volumes of the various pathway segments can be appropriately adjusted. In practice the most expedient adjustment is to modify the cross-sectional areas of the channels to the desired component ratio, as discussed above in conjunction with FIG. 8.

The techniques of forming the cover plates and the conveying plate depend upon the materials used for these members. Suitable materials include polymer materials, composite materials, crystalline materials, glass, and metals.

If the cover plates and conveying plate are fabricated from a polymer material or a composite material the grooves on both the first and second surfaces of the conveying plate and the recesses in the cover plates may be formed by molding. The supply ports are also formed during the molding process. Either compression molding or injection molding techniques can be used. With such materials the cover plates may be bonded (e.g., ultrasonically welded) to the conveying plate.

If the cover plates and conveying plate are fabricated from a metallic material other than a crystalline material the grooves on both the first and second surfaces of the conveying plate as well as the recesses and the supply ports in the cover plates may be formed by any suitable machining method, such as abrasive machining using a diamond-coated tool. In such a construction the cover plates may be bonded to the conveying plate by any suitable technique, such as soldering.

The preferred material for the cover plates 20, 22 is glass, particularly borosilicate glass or fused quartz. For such materials the recesses in the cover plates are formed by abrasive machining, i.e. using diamond-coated or carbide tools. The supply ports 20$S^1$, 22$S^1$ or 20$S^3$, 22$S^3$ may be formed by abrasive drilling, preferably using a diamond-coated drill or diamond-coated hole saw. Supply ports 20$S^2$, 22$S^2$ are formed by abrasive machining, preferably machining using a diamond-coated tool. For cover plates made of crystalline materials the recesses may be formed by etching or abrasive machining while the supply ports may be formed using a diamond-coated tool or a laser cutter.

The preferred material for the conveying plate 12 is a crystalline material, particularly silicon, most particularly silicon having a <100> crystal orientation. For this material the grooves on both the first and second surfaces are formed by etching. If the conveying plate 12 is formed from glass the grooves are formed using a diamond-coated tool. If a port through the conveying plate is required it may be formed using a laser cutter or a diamond-coated drill.

The preferred combination of materials for the mixing device $10^1$, $10^2$, $10^3$ is cover plates formed from borosilicate glass and a conveying plate formed from <100> crystalline silicon. In such a combination the glass cover plates are anodically bonded to the silicon conveying plate.

Regardless of the materials used for the cover plates and the conveying plate the surfaces of the channels are treated so that they lack affinity for any component of an adhesive. The preferred surface treatment method is the deposition of a siloxane-containing layer.

METHOD OF FABRICATION In general, a plurality of mixing devices is formed in groups. Each mixing device includes cover plates formed from the preferred material, viz., borosilicate glass, and a conveying plate formed from <100> crystalline silicon.

Figure 19:
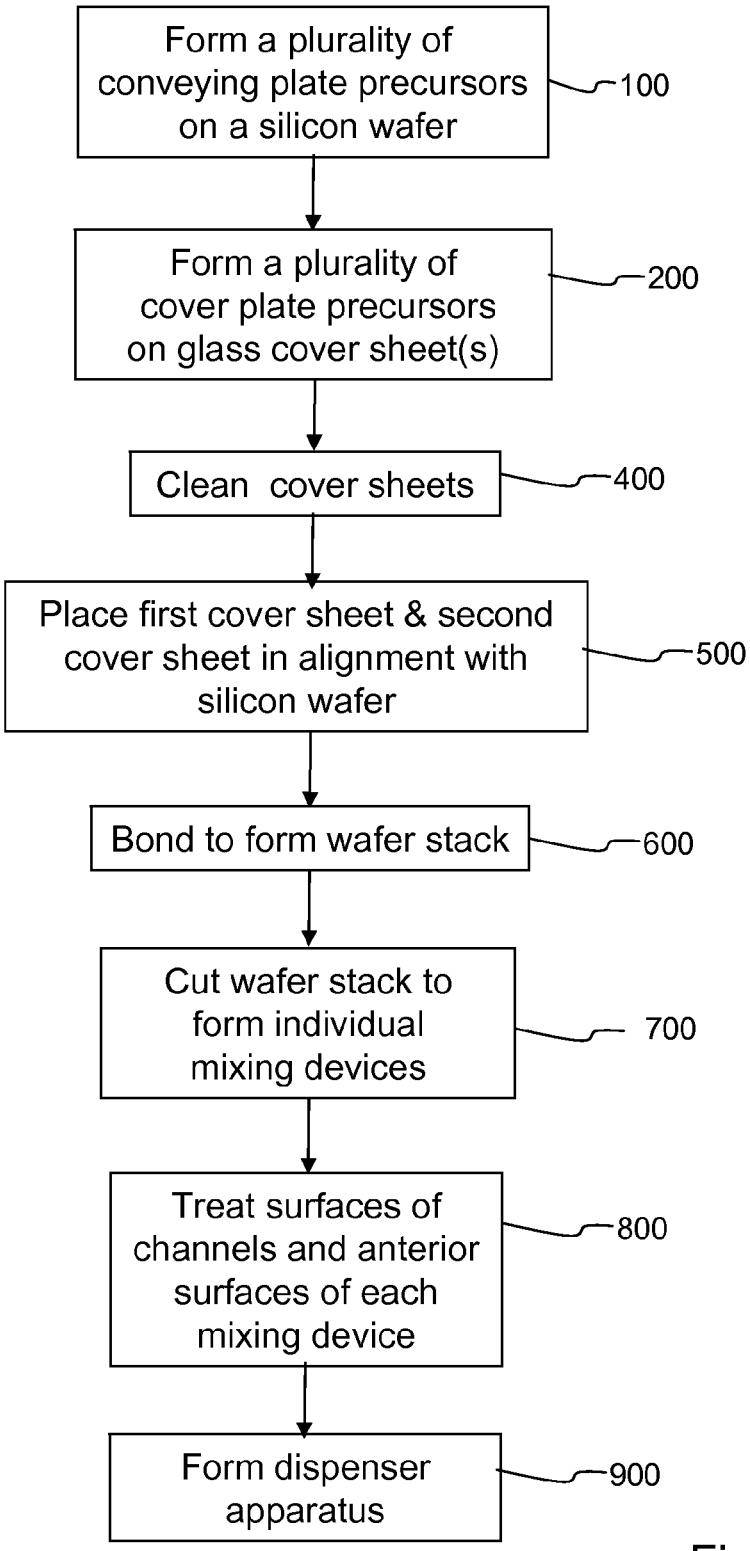
FIG. 19 is a flow chart showing an overall fabrication process for a mixing device in accordance with another aspect of the present invention.

As indicated in FIG. 19 at block 100 a plurality of conveying plate precursors is formed on portions of a silicon wafer. A plurality of sets of grooves is created on opposed first and second surfaces of the silicon wafer. Each set of grooves on the first surface overlies a corresponding set of grooves on the second surface. Each groove in a groove set on the first surface is separated from a groove in its corresponding groove set on the second surface by a web. Each groove in each groove set on one surface is separated from an adjacent groove in that set by a land. If desired, cavities that eventually cooperate to define distribution manifolds may be formed in the surfaces of the wafer. Any ports needed to communicate with distribution manifolds may also be formed through the wafer.

In block 200 a plurality of cover plate precursors are formed on portions of respective first and a second glass sheets. Recesses that eventually define distribution manifolds are formed in each glass sheet. Depending upon the embodiment of the mixing device being fabricated and the eventual arrangement of supply ports therein, at least one (or both) of the glass sheets has an array of appropriately arranged openings formed therein.

After the wafer and cover sheets are cleaned (block 400) the cover sheets and the silicon wafer are placed in precise alignment (block 500). One of the cover sheets is placed over a first surface of the wafer and the other cover sheet is placed over a second surface of the wafer so that the recesses in each cover sheet align with a respective set of grooves on the wafer. Since the glass cover sheets are transparent a microscope with a video camera may be used to perform the alignment. Optional alignment indicia on the cover sheets and silicon wafer may be used to insure precise alignment before bonding.

If the cover sheets are made of a crystalline material, such as silicon, an infrared sensitive video camera could be substituted for the video camera to perform the alignment of cover sheets to the grooved silicon wafer.

This is possible since silicon is somewhat transparent in the infrared.

As indicated in the block 600 the aligned cover sheets are bonded to respective surfaces of the grooved silicon wafer to form a wafer stack. To achieve good bonding the surfaces should be highly planar and any oxide layers on each surface of the silicon wafer should be undamaged. The preferred procedure is to align and to anodically bond the glass cover sheets one at a time to the silicon wafer. If the cover sheets are comprised of silicon they may be fusion bonded to the grooved silicon wafer.

In block 700 the bonded wafer stack is cut (as with a diamond dicing saw) into a plurality of individual mixing devices so that each mixing device has a conveying plate and first and second cover plates. Each first and second cover plate is formed from a precursor portion of a respective cover sheet and the conveying plate is formed from a precursor portion of the wafer. The stack is cut so that the discharge end of each channel extends to the anterior surface of each individual mixing device.

The cover plates (20, 22) and the conveying plate (12) of each mixing device (10$^1$, 10$^2$, 10$^3$) thereby cooperate to define:

- a plurality of first and second sets of separated channels (30, 32) extending through the mixing device, each channel having a supply end (30S, 32S) and a discharge end (30D, 32D);
- a first and a second distribution manifold (40, 42 or 40', 42') each in fluid communication with the supply ends of the respective set of channels; and
- a first and a second supply port (20S$^1$, 22S$^1$ or 20S$^2$, 22S$^2$ or 20S$^3$, 22S$^3$) disposed in fluid communication with a respective one of the first and second distribution manifolds.

As disclosed in block 800 the channels 30, 32 of each mixing device may be individually treated to deposit a siloxane-containing layer 36 (FIG. 3A). The anterior surface 10A of each mixing device may also be individually so treated (FIGS. 5 or 6).

As seen in block 900, a dispenser apparatus 110$^1$, 110$^2$ or 110$^3$ is formed by connecting and physically attaching an appropriately configured header 50$^1$, 50$^2$ or 50$^3$ to a respective mixing device 10$^1$, 10$^2$ or 10$^3$. As discussed earlier the appropriate mode of attachment depends upon the materials of construction of the header and the mixing device.

Figure 20:
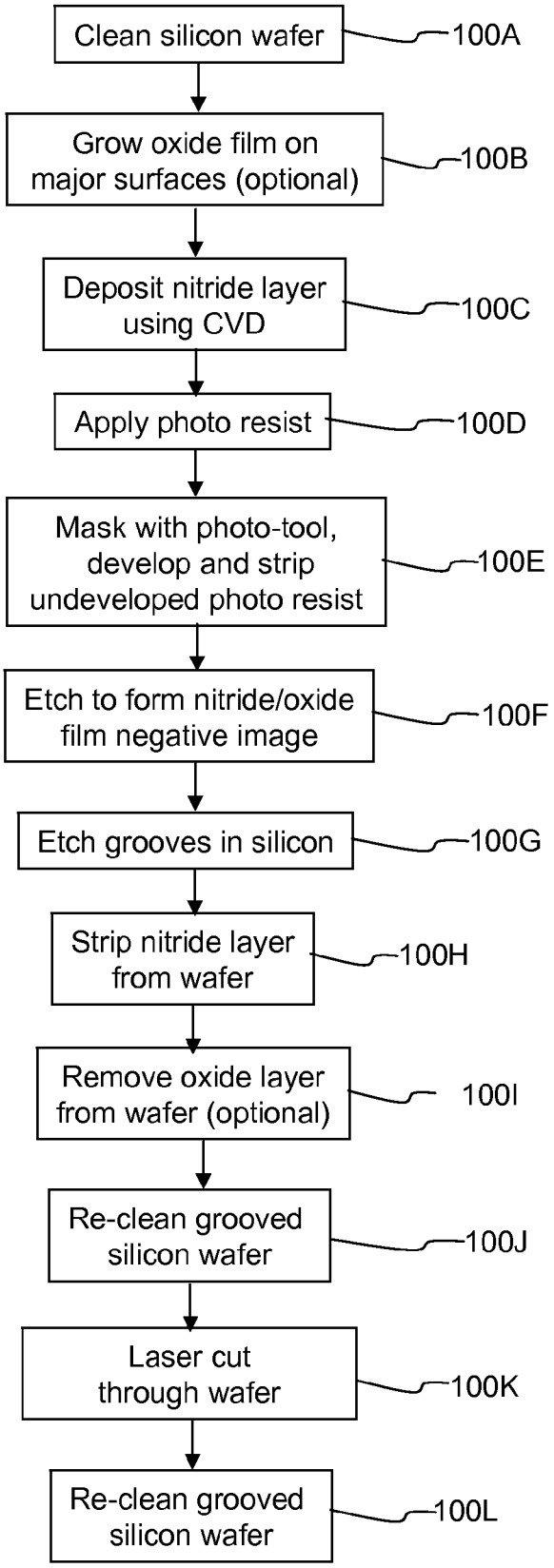
FIG. 20 is a flow chart showing a process for fabricating a conveying plate.

The flow chart of FIG. 20 shows the individual steps within the block 100 of FIG. 19 for forming the plurality of conveying plate precursors. These individual steps generally correspond to known semiconductor processing techniques for silicon wafers. The photo-tools for the patterns for each side of the wafer are prepared using well known computer-aided-design techniques. The photo-tools define an image of the desired pattern for the grooves 14G, 16G (and the optional cavities 14C, 16C). Polished silicon wafers, having the preferred <100> crystal plane (or other orientations) on the major surfaces may be purchased from commercial sources. Suitable polished wafers are available from Silicon Quest International, Santa Clara, Calif.

The polished wafers are first cleaned using a well known general cleaning technique, such as the "RCA process" (block 100A).

An oxide film may optionally be grown on the wafer using well known standard techniques (block 100B). The presence of an oxide layer is desirable because it facilitates several of the later steps.

A nitride layer is deposited over the oxide layer using a known chemical vapor deposition ("CVD") method (block 100C). The nitride layer protects the oxide layer from attack by the etchant that is subsequently used to etch the silicon.

Using the well known spin coating technique a photoresist is applied (block 100D) in accordance with manufacturer directions.

The wafer is masked (block 100E) with a photo-tool that is precisely aligned with the crystal planes of the wafer. Straight portions of the pattern on the photo-tool are typically aligned along the <110> crystal plane. After exposing and developing the photoresist the undeveloped photoresist is stripped to expose part of the nitride/oxide film layer.

The exposed nitride/oxide film is etched to form a nitride/oxide negative image mask of the desired pattern (block 100F). Preferably both sides of the wafer may be masked with resist; the resist exposed with the desired pattern on each surface; the resist developed and washed; and the nitride/oxide etched simultaneously on both surfaces.

The sets of grooves are then formed in the surfaces of the wafers by etching the silicon (block 100G) using either an isotropic or anisotropic etchant. The choice of etchant depends on the desired shape and arrangement of the grooves. If a triangular or trapezoidal cross-section groove shape is desired an anisotropic etchant is used. Straight grooves may be formed using either etchant, but curved grooves must be etched using an isotropic etchant.

In the preferred case the nitride/oxide masked silicon wafer is etched on both major surfaces using the same etchant. The etching may be simultaneously performed on both surfaces. If different etchants are to be used on each side of the wafer the first side is etched using a first etchant. The second side is then etched using a second etchant.

The nitride layer of the negative image is stripped from the wafer (block 100H) using a suitable solvent, such as boiling phosphoric acid, to expose the undamaged oxide layer.

The remaining oxide layer of the negative image may optionally be removed from the wafer by using a suitable solvent such as buffered hydrogen fluoride (block 100I).

The wafer is then re-cleaned (block 100J) using the same "RCA process" technique as described above.

As noted in block 100K, after all the etching steps have been completed any ports through the wafer (such as the portion of the supply port 22S$^3$ in the conveying plate 12 in FIGS. 13, 14B) are formed by laser cutting through the wafer, typically using a pulsed neodymium-YAG laser cutting system. Alternatively a diamond burr may be used.

The wafer is again re-cleaned to remove cutting debris (block 100L).

EXAMPLES

A series of mixing devices 101 in accordance with the first embodiment was fabricated from the preferred materials using the method of fabrication described in conjunction with FIGS. 19 and 20.

A one hundred millimeter (100 mm) diameter <100> crystal orientated silicon wafer was used to form the conveying plate precursors. An anisotropic potassium hydroxide (KOH) etchant bath was used to etch the grooves on both surfaces of the silicon wafer. Each groove was separated from a groove on the opposite surface by a web one hundred micrometers (100 μm) thick. Owing to the thickness of the web the channels of the mixing device were spaced approximately one hundred micrometers (100 μm) apart.

One hundred millimeter (100 mm) diameter by one millimeter (1 mm) thick borosilicate glass sheets were used to form the cover plate precursors.

Mixing devices having two different sizes of channels were fabricated, viz.:

1) five hundred micrometers by two hundred micrometers (500×200 μm) channels (labeled "large" channel mixing devices); and
2) three hundred fifty hundred micrometers by two hundred micrometer (350×200 μm) channels (labeled "small" channel mixing devices).

Mixing devices having from two (2) to six (6) channels on each surface of the conveying plate were fabricated so that each mixing device created an output stream of adhesive having differing widths. All test results disclosed hereafter were obtained from mixing devices having six (6) channels on each surface of the conveying plate (labeled "2×6" mixing devices).

The channels and anterior surface of each mixing device was coated with a siloxane-containing material.

Dispenser apparatus as disclosed in FIG. 15 were formed by attaching a first and a second header block (using a UV curable epoxy adhesive) to the respective first and second cover plates of each mixing device.

A first adhesive component (described hereinafter) was supplied from a first barrel of a two-barrel syringe (as shown in FIG. 15), through the passage in the header, through the first supply port and into the first distribution manifold. A second adhesive component (described hereinafter) was supplied from the second barrel of the two-barrel syringe, through the passage in the header, through the second supply port and into the second distribution manifold. The flow of each respective adhesive component from the respective distribution manifolds passed through the respective first and second channels. The first and second components flowed from the interdigitated discharge ends of the channels in an alternating fashion to form a merged stream beyond the mixing device. The first and second adhesive components diffused together and chemically reacted to form a hydrogel. Since the chemical reaction occurred outside of the mixing device the increase in viscosity as the components formed the hydrogel did not plug the channels of the device.

Example 1

This experiment compared the mixing performance of the two mixing devices described above to control specimens made using a prior art sixteen-step static mixer available from MedMix Systems AG Rotkreuz, Switzerland as Part Number ML 2.5-16-LM(V01). The degradation time of a hydrogel adhesive made by mixing two adhesive components with each mixing device was compared. All mixing tests used hydrogel specimens made from the same two adhesive components.

Component 1 was an aqueous solution of two dextran aldehydes coded as D60-27-20/D10-49-25 mixed in a 4:1 volume ratio. The code D60-27-20 indicated that the first dextran aldehyde had a molecular weight of sixty thousand (60,000) with a twenty-seven percent (27%) oxidation level of the aldehyde ends at a twenty percent (20%) solids content. The D10-49-25 code indicated that the second dextran aldehyde had a molecular weight of ten thousand (10,000) with forty-nine percent (49%) oxidation level of the aldehyde ends at a twenty-five percent (25%) solids content.

Component 2 was an aqueous solution of two polyethylene glycol (PEG) amines coded as P8-10-1/P4-2-1 in a 2.7:1 weight ratio at a solids content of fifty-five percent (55%). The P8-10-1 code indicated that the first PEG amine had eight arms, a molecular weight of ten thousand (10,000) and one amine group per end of each PEG arm. The P4-2-1 code indicated that the second PEG amine had four arms, a molecular weight of two thousand (2,000) and one amine group per end of each PEG arm.

The control specimens: Three control specimens of hydrogel adhesive (designated "Control 1 Static Mixer", "Control 2 Static Mixer" and "Control 3 Static Mixer"), each having a different dispensed weight, were created by mixing the same two adhesive components (Component 1 and Component 2) as described above. For the control specimens the mixing was accomplished by simultaneously dispensing equal volumes of the two adhesive components through the prior art sixteen step static mixer and depositing the mixture onto a smooth surface.

The hydrogel control specimens were allowed to cure for fifteen minutes, then weighed.

The control specimens were incubated as follows. The specimens were placed in a twenty milliliter (20 ml) scintillation vial (Article No. VW74512-20, Disposable Scintillation Vials, available from VWR International, LLC of West Chester, Pa.) filled with twenty milliliters (20 ml) of a phosphate buffered saline solution (GIBCO® Reference No. 14190-136, DPBS 1× Dulbecco's Phosphate Buffered Saline, available from Invitrogen Corp., Calsbad, Calif.). The vial was placed in a rotating incubation oven (model Innova 4230 Incubator Shaker, available from New Brunswick Scientific, Edison, N.J.) at thirty-seven degrees Centigrade (37° C.) rotating at eighty revolutions per minute (80 rpm).

After six hours in the oven, the control specimens were removed from the vial and placed on a screen to dry. The control specimens were then dabbed with an absorbent paper to remove any residual liquid and weighed. The weight was recorded and the control specimens were returned to the vial which was filled with twenty milliliter (20 ml) of fresh phosphate buffered saline solution. The vial was then returned to the incubation oven at thirty-seven degrees Centigrade (37° C.) rotating at eighty revolutions per minute (80 rpm).

The drying and weighing procedure was performed again at the twenty-four, forty-eight and seventy-two hour time points or until the remaining hydrogel control specimen weight was negligible.

Test specimens were formed using the mixing devices of the present invention as described above.

Four test specimens of hydrogel adhesive (labeled "2×6 mixer 1-small channel" through "2×6 mixer 4-small channel") were created using the small channel mixing devices described above. Three test specimens of hydrogel adhesive (labeled "2×6 mixer 1-large channel" through "2×6 mixer 3-large channel") were created using the large channel mixing devices described above. Each test specimen had a dispensed weight corresponding approximately to the weight of one of the control specimens. Test specimens were prepared by simultaneously dispensing equal volumes of the two adhesive components through one of the mixing devices and depositing the mixture on a smooth surface. The specimens were then cured and weighed, then incubated, dried and weighed in accordance with the test method described above for the control specimens.

The Experimental Results are shown in Table 1 below.

TABLE 1

Experimental Results

| Mixer Type | Average Specimen Weigh (grams) at time: 0 hr | 6 hrs | 24 hrs | 48 hrs | 72 hrs |
|---|---|---|---|---|---|
| Control 1 - Static Mixer | 0.47 | 1.41 | 0.82 | 0.28 | 0 |
| Control 2 - Static Mixer | 0.38 | 0.48 | 0 | na | na |
| Control 3 - Static Mixer | 0.25 | 0 | na | na | na |
| 2 × 6 mixer 1 - small channel | 0.47 | 0.84 | 0.23 | 0.14 | 0 |
| 2 × 6 mixer 2 - small channel | 0.26 | 0.05 | 0 | na | na |
| 2 × 6 mixer 3 - small channel | 0.22 | 0 | na | na | na |
| 2 × 6 mixer 4 - small channel | 0.24 | 0.07 | 0 | na | na |
| 2 × 6 mixer 1 - large channel | 0.43 | 0.46 | 0.13 | 0.06 | 0 |
| 2 × 6 mixer 2 - large channel | 0.21 | 0 | na | na | na |
| 2 × 6 mixer 3 - large channel | 0.21 | 0 | na | na | na |

"na"—"not applicable" (because previous weight was negligible)

All of the control specimens and all of the test specimens degraded by seventy-two hours. The control specimens and the test specimens having corresponding initial weights degraded in a similar weight-versus-time profile, indicating that the mixing efficiency of each mixing device in accordance with the present invention is equivalent to the mixing efficiency of the prior art device used as the control.

Example 2

This experiment was conducted to determine if a mixing device in accordance with the present invention (a "2×6 mixer—small channel" device as described in Example 1) was able to dispense multiple aliquots of mixed hydrogel adhesive without experiencing clogging.

The two liquid adhesive components were dispensed through the mixing device. The adhesive components were dispensed in repeated six hundred microliter (600 μl) aliquots using a two-barrel syringe. After each aliquot the tip of the mixing device was wiped with a razor blade to remove any residual adhesive material. This was followed by five- or ten-minute waiting periods before the next aliquot was dispensed. The test was run for a total time of fifty (50) minutes.

The mixing device in accordance with the present invention was able to dispense seven aliquots (at zero minutes, five minutes, ten minutes, twenty minutes, thirty minutes, forty minutes and fifty minutes) without clogging.

The prior art static mixer was used as the control. The prior art device was able to make only a single aliquot, because after a thirty-second (30 sec) waiting period the static mixer clogged sufficiently to prevent manual dispensing.

-o-0-o-

Those skilled in the art, having the benefit of the teachings of the present invention as hereinabove set forth may effect numerous modifications thereto. Such modifications are to be construed as lying within the contemplation of the present invention as defined by the appended claims.

What is claimed is:

1. A mixing device for mixing adhesives containing at least two components comprising:

a first and a second cover plate; and a conveying plate having first and second surfaces thereon, each surface having a plurality of grooves formed therein, each groove on each surface being separated from an adjacent groove on that surface by a land, the first and the second cover plates respectively overlaying the first and second surfaces on the conveying plate with the lands on each respective surface of the conveying plate being disposed in contact against the cover plate overlying that surface thereby to define separated channels extending through the mixing device, each channel having a discharge end, a first and a second distribution manifold defined within the mixing device, each distribution manifold being respectively disposed in fluid communication with each of a selected plurality of channels, thereby to define first and second sets of channels, the channels being arranged such that the discharge end of at least one of the channels in the first set of channels is next adjacent to the discharge end of at least one of the channels in the second set of channels, a first and a second supply port disposed in fluid communication with a respective one of the first and second distribution manifolds, each supply port being adapted to receive one of the components of the adhesive, and wherein the discharge end of each of the channels is on the exterior of the mixing device whereby the two components form a merged stream beyond the mixing device.

2. The mixing device of claim 1 wherein each channel also has a supply end, each of the cover plates and a respective surface of the conveying plate cooperate to define the first and the second distribution manifolds within the mixing device, each distribution manifold respectively communicating with the supply ends of a respective set of channels.

3. The mixing device of claim 1 wherein the first supply port extends through the first cover plate and into fluid communication with the first distribution manifold and the second supply port extends through the second cover plate into fluid communication with the second distribution manifold.

4. The mixing device of claim 1 wherein each cover plate has a rear edge surface thereon; and the conveying plate has a rear edge surface thereon, the rear edge surfaces on the cover plates and the rear edge surface on the conveying plate defining a posterior surface of the mixing device, the first supply port and the second supply port extend through the posterior surface of the mixing device and into fluid communication with the respective first and second distribution manifold.

5. The mixing device of claim 1 wherein each cover plate has a rear edge surface thereon;

the conveying plate has a rear edge surface thereon;

the rear edge surfaces on the cover plates and the rear edge surface on the conveying plate defining a posterior surface of the mixing device, each of the cover plates and a respective surface of the conveying plate cooperate to define the first and the second distribution manifolds within the mixing device, each distribution manifold respectively communicating with the supply ends of a respective set of channels, the first supply port and the second supply port extend through the posterior surface of the mixing device and into fluid communication with the respective first and second distribution manifold.

6. The mixing device of claim 1 wherein each of the cover plates and a respective surface of the conveying plate cooperate to define the first and the second distribution manifold within the mixing device, each distribution manifold respectively communicating with the supply ends of the first and second sets of channels, and the first supply port extending through the first cover plate and into fluid communication with the first distribution manifold and the second supply port extending through both the first cover plate and the conveying plate into fluid communication with the second distribution manifold.

7. The dispenser apparatus of claim 6 wherein the distribution manifolds are offset from each other.

8. A mixing device for mixing adhesives containing at least two components comprising:

a first and a second cover plate; and a conveying plate having first and second surfaces thereon, each surface having a plurality of grooves formed therein, each groove on each surface being separated from an adjacent groove on that surface by a land, the first and the second cover plates respectively overlaying the first and second surfaces on the conveying plate with the lands on each respective surface of the conveying plate being disposed in contact against the cover plate overlying that surface thereby to define first and second sets of separated channels extending through the mixing device, the first set of channels extending along the first surface of the conveying plate and the second set of channels extending along the second surface of the conveying plate, each channel having a supply end and a discharge end, the channels being arranged such that the discharge end of each channel in the first set of channels is next adjacent to the discharge end of at least one of the channels in the second set of channels, each of the cover plates and a respective surface of the conveying plate cooperating to define a first and a second distribution manifold within the mixing device, each distribution manifold respectively communicating with the supply ends of the first and second sets of channels, and a first supply port extending through the first cover plate and into fluid communication with the first distribution manifold and a second supply port extending through the second cover plate into fluid communication with the second distribution manifold, each supply port being adapted to receive one of the components of the adhesive, wherein the discharge end of each of the channels is on the exterior of the mixing device whereby the two components form a merged stream beyond the mixing device.

9. The mixing device of claim 8 wherein each channel in the first set of channels is separated from a next adjacent channel in the second set of channels by a web formed in the conveying plate.

10. The mixing device of claim 8 wherein the portions of the surface of the conveying plate having the grooves therein and the portions of the surface of the cover plates cooperating therewith to define the channels lack affinity for either component of the adhesive.

11. The mixing device of claim 8 wherein the conveying plate and each of the cover plates have an edge surface at the discharge end of the channels, and wherein the edge surfaces of the conveying plate and the cover plates are coplanar.

12. The mixing device of claim 11 wherein the edge surface of each cover plate and the edge face of the conveying plate lack affinity for either component of the adhesive.

13. The mixing device of claim 11 wherein the coplanar edge surfaces of the conveying plate and each cover plate are perpendicular to the axes of the channels.

14. The mixing device of claim 11 wherein the coplanar edge surfaces of the conveying plate and each cover plate are inclined with respect to the axes of the channels.

15. The mixing device of claim 8 wherein each of the cover plates has an edge surface at the discharge end of the channels, and wherein the edge surface of each of the cover plates has a rounded corner.

16. The mixing device of claim 8 wherein the surface of the first cover plate that confronts the conveying plate has a recess formed therein, the recess defining the first distribution manifold.

17. The mixing device of claim 16 wherein the first surface of the conveying plate has a cavity formed therein, the recess in the first cover plate and the cavity in the conveying plate cooperate to define the first distribution manifold.

18. The mixing device of claim 16 wherein the surface of the second cover plate that confronts the conveying plate also has a recess formed therein, the recess defining the second distribution manifold.

19. The mixing device of claim 18 wherein the second surface of the conveying plate also has a cavity formed therein, the recess in the second cover plate and the second cavity in the conveying plate cooperate to define the second distribution manifold.

20. The mixing device of claim 8 wherein each channel in the first and second sets of channels has a predetermined cross-sectional area measured in a plane perpendicular to the axis extending therethrough, and wherein the ratio of the cross sectional area of a channel in the first set is substantially equal to the ratio of the cross sectional area of a channel in the second set.

21. The mixing device of claim 8 wherein each channel in the first and second sets of channels has a predetermined cross-sectional area measured in a plane perpendicular to the axis extending therethrough, and wherein the ratio of the cross sectional area of a channel in the first set is different than the ratio of the cross sectional area of a channel in the second set.

* * * * *